US007432786B2

(12) United States Patent
Tomaki et al.

(10) Patent No.: US 7,432,786 B2
(45) Date of Patent: Oct. 7, 2008

(54) HIGH FREQUENCY FILTER

(75) Inventors: Shigemitsu Tomaki, Tokyo (JP); Shinichiro Toda, Tokyo (JP); Hideya Matsubara, Tokyo (JP); Atsunori Okada, Tokyo (JP)

(73) Assignee: TDK Corporation, Tokyo (JP)

( * ) Notice: Subject to any disclaimer, the term of this patent is extended or adjusted under 35 U.S.C. 154(b) by 133 days.

(21) Appl. No.: 11/654,597

(22) Filed: Jan. 18, 2007

(65) Prior Publication Data

US 2007/0176712 A1 Aug. 2, 2007

(30) Foreign Application Priority Data

Jan. 31, 2006 (JP) ..... 2006-022145

(51) Int. Cl.
*H01P 1/20* (2006.01)
*H01P 3/08* (2006.01)

(52) U.S. Cl. ..... 333/204; 333/185; 333/219

(58) Field of Classification Search ..... 333/204, 333/26, 134, 185, 219
See application file for complete search history.

(56) References Cited

U.S. PATENT DOCUMENTS 5,719,539 A 2/1998 Ishizaki et al.
6,696,903 B1 2/2004 Kawahara et al.
7,116,188 B2 * 10/2006 Kawahara et al. ..... 333/134
7,126,444 B2 10/2006 Fukunaga et al.
2006/0255886 A1 * 11/2006 Ninomiya et al. ..... 333/204

FOREIGN PATENT DOCUMENTS

| | | |
|---|---|---|
| JP | A-7-312503 | 11/1995 |
| JP | A 2000-022404 | 1/2000 |
| JP | A 2001-053502 | 2/2001 |
| JP | A 2003-318605 | 11/2003 |
| JP | A 2005-045447 | 2/2005 |
| JP | A 2005-080248 | 3/2005 |
| JP | A-2005-159512 | 6/2005 |

* cited by examiner

*Primary Examiner*—Anh Q Tran
(74) *Attorney, Agent, or Firm*—Oliff & Berridge, PLC

(57) ABSTRACT

A high frequency filter incorporates first to third resonators provided inside a layered substrate. The first and third resonators are adjacent to each other and inductively coupled to each other. The second and third resonators are also adjacent to each other and inductively coupled to each other. The first and second resonators are not adjacent to each other but are capacitively coupled to each other through a conductor layer for capacitive coupling. The conductor layer for capacitive coupling incorporates: a first portion for forming a first capacitor between itself and the first resonator; a second portion for forming a second capacitor between itself and the second resonator; and a third portion having an end connected to the first portion and the other end connected to the second portion, the ends being opposed to each other in the longitudinal direction. The width of at least part of the third portion is smaller than the width of each of the first portion and the second portion.

12 Claims, 21 Drawing Sheets

HIGH FREQUENCY FILTER

BACKGROUND OF THE INVENTION

1. Field of the Invention

The present invention relates to a layered high frequency filter incorporating at least three resonators.

2. Description of the Related Art

With increasing demands for reductions in dimensions and thickness of communications apparatuses conforming to the Bluetooth standard and those for use on a wireless local area network (LAN), techniques for high-density packaging has been required. One of proposals for meeting such a requirement is to integrate components through the use of a layered substrate.

One of components of the above-mentioned communications apparatuses is band-pass filters that filter reception signals. As the band-pass filters, layered band-pass filters such as those disclosed in JP 2003-318605A and JP 2001-053502A are known. The layered band-pass filters each incorporate a plurality of resonators formed using conductor layers of a layered substrate. In each of the layered band-pass filters, respective adjacent ones of the resonators are inductively coupled to each other. For the layered band-pass filters, as disclosed in the above-mentioned publications, there are cases in which the respective adjacent ones of the resonators are also capacitively coupled to each other. In such cases, it is possible to adjust the frequencies of two attenuation poles and the pass-band width of each of the band-pass filters by adjusting the magnitude of the inductive coupling and the magnitude of the capacitive coupling. Thus, capacitively coupling the respective adjacent ones of the resonators to each other makes it easier to adjust the characteristics of the band-pass filters, compared with a case in which the respective adjacent ones of the resonators are not capacitively coupled to each other.

JP 2001-053502A discloses a technique of capacitively coupling non-adjacent resonators to each other through the use of a series circuit including a transmission line and two bypass capacitors. The filter disclosed in this publication incorporates: three resonator electrodes; two inter-stage coupling capacitor electrodes that are respectively opposed to two of the resonator electrodes adjacent to each other; and one bypass electrode opposed to the two inter-stage coupling capacitor electrodes. In this filter, two inter-stage coupling capacitors that capacitively couple two adjacent resonators to each other are formed of the adjacent two of the resonator electrodes and one of the inter-stage coupling capacitor electrodes opposed to the two of the resonator electrodes. In addition, two bypass capacitors are formed of the two inter-stage coupling capacitor electrodes and the bypass electrode opposed to the two inter-stage coupling capacitor electrodes. It is possible, through this technique, to control the attenuation pole by adjusting the capacitance between the non-adjacent resonators without being affected by the magnetic field coupling between the non-adjacent resonators.

In the technique disclosed in JP 2001-053502A, the inter-stage coupling capacitor electrodes are shared between the inter-stage coupling capacitors and the bypass capacitors. As a result, according to this technique, it is difficult to control the capacitance of the bypass capacitors independently of the capacitance of the inter-stage coupling capacitors. In addition, it is impossible through this technique to capacitively couple the non-adjacent resonators to each other without capacitively coupling adjacent resonators to each other. It is therefore difficult to adjust the characteristics of the band-pass filter through this technique.

OBJECTS AND SUMMARY OF THE INVENTION

It is an object of the invention to provide a layered high frequency filter incorporating at least three resonators, the filter being capable of allowing easy adjustment of characteristics thereof.

A first or second high frequency filter of the invention incorporates: a layered substrate including dielectric layers and conductor layers that are alternately stacked; and a first resonator, a second resonator and a third resonator each of which is formed using at least one of the conductor layers inside the layered substrate. The third resonator is disposed between the first and second resonators. The first and third resonators are inductively coupled to each other while the second and third resonators are inductively coupled to each other.

The first high frequency filter of the invention further incorporates at least one conductor layer for capacitive coupling that is made of at least one of the conductor layers inside the layered substrate and that is provided for capacitively coupling the first and second resonators to each other. The at least one conductor layer for capacitive coupling incorporates: a first portion for forming a first capacitor between itself and the first resonator; a second portion for forming a second capacitor between itself and the second resonator; and a third portion having an end connected to the first portion and the other end connected to the second portion, the ends being opposed to each other in a longitudinal direction. The width of at least part of the third portion is smaller than the width of each of the first portion and the second portion.

According to the first high frequency filter of the invention, the at least one conductor layer for capacitive coupling is provided for capacitively coupling the first and second resonators that are not adjacent to each other. In the at least one conductor layer for capacitive coupling, the width of at least part of the third portion is smaller than the width of each of the first portion and the second portion. As a result, according to the invention, the capacitance generated between the third portion and the third resonator is smaller, compared with the case in which the width of at least part of the third portion is equal to or greater than the width of each of the first portion and the second portion.

In the first high frequency filter of the invention, the width of the at least part of the third portion may be equal to or smaller than a half of the width of each of the first portion and the second portion.

The first high frequency filter of the invention may further incorporate a first electrode, a second electrode and a third electrode each of which is made of one of the conductor layers inside the layered substrate, the first to third electrodes being connected to the first to third resonators, respectively, and the first to third electrodes may be opposed to the first to third portions, respectively, with one of the dielectric layers inside the layered substrate disposed in between.

In the first high frequency filter of the invention, the first and third resonators may be further capacitively coupled to each other, and the second and third resonators may be further capacitively coupled to each other.

In the first high frequency filter of the invention, each of the first to third resonators may be a half-wave resonator with open ends, and the number of the at least one conductor layer for capacitive coupling may be two. One of the two conductor layers for capacitive coupling may couple one of the ends of the first resonator to one of the ends of the second resonator, while the other of the two conductor layers for capacitive coupling may couple the other of the ends of the first resonator to the other of the ends of the second resonator.

In the first high frequency filter of the invention, each of the first to third resonators may be a quarter-wave resonator having an open end with the other end short-circuited, and the at least one conductor layer for capacitive coupling may couple the other end of the first resonator to the other end of the second resonator.

A second high frequency filter of the invention further incorporates at least one conductor layer for capacitive coupling that is made of at least one of the conductor layers inside the layered substrate and that is provided for capacitively coupling the first and second resonators to each other. The at least one conductor layer for capacitive coupling incorporates: a capacitor-forming portion for forming a capacitor between itself and one of the first and second resonators; and a coupling portion having an end connected to the capacitor-forming portion and the other end connected to the other one of the first and second resonators, the ends being opposed to each other in a longitudinal direction. The width of at least part of the coupling portion is smaller than the width of the capacitor-forming portion.

According to the second high frequency filter of the invention, the at least one conductor layer for capacitive coupling is provided for capacitively coupling the first and second resonators that are not adjacent to each other. In the conductor layer for capacitive coupling, the width of at least part of the coupling portion is smaller than the width of the capacitor-forming portion. As a result, according to the invention, the capacitance generated between the coupling portion and the third resonator is smaller, compared with the case in which the width of at least part of the coupling portion is equal to or greater than the width of the capacitor-forming portion.

In the second high frequency filter of the invention, the width of the at least part of the coupling portion may be equal to or smaller than a half of the width of the capacitor-forming portion.

The second high frequency filter of the invention may further incorporate a first electrode, a second electrode and a third electrode each of which is made of one of the conductor layers inside the layered substrate, the first to third electrodes being connected to the first to third resonators, respectively. One of the first and second electrodes may be opposed to the capacitor-forming portion with one of the dielectric layers inside the layered substrate disposed in between, while the third electrode may be opposed to the coupling portion with one of the dielectric layers inside the layered substrate disposed in between.

In the second high frequency filter of the invention, the first and third resonators may be further capacitively coupled to each other, and the second and third resonators may be further capacitively coupled to each other.

In the second high frequency filter of the invention, each of the first to third resonators may be a half-wave resonator with open ends, and the number of the at least one conductor layer for capacitive coupling may be two. One of the two conductor layers for capacitive coupling may couple one of the ends of the first resonator to one of the ends of the second resonator, while the other of the two conductor layers for capacitive coupling may couple the other of the ends of the first resonator to the other of the ends of the second resonator.

In the second high frequency filter of the invention, each of the first to third resonators may be a quarter-wave resonator having an open end with the other end short-circuited, and the at least one conductor layer for capacitive coupling may couple the other end of the first resonator to the other end of the second resonator.

According to the first high frequency filter of the invention, in the at least one conductor layer for capacitive coupling, the width of at least part of the third portion is smaller than the width of each of the first portion and the second portion. As a result, according to the invention, it is possible to make the capacitance generated between the third portion and the third resonator smaller, compared with the case in which the width of the third portion is equal to or greater than the width of each of the first portion and the second portion. As a result, according to the invention, it is possible to adjust the magnitude of capacitive coupling between the first and second resonators that are not adjacent to each other while reducing the magnitude of capacitive coupling between the first and third resonators and the magnitude of capacitive coupling between the second and third resonators generated by the at least one conductor layer for capacitive coupling. As a result, according to the invention, it is easy to adjust the characteristics of a layered high frequency filter incorporating at least three resonators.

According to the second high frequency filter of the invention, in the at least one conductor layer for capacitive coupling, the width of at least part of the coupling portion is smaller than the width of the capacitor-forming portion. As a result, according to the invention, it is possible to make the capacitance generated between the coupling portion and the third resonator smaller, compared with the case in which the width of at least part of the coupling portion is equal to or greater than the width of the capacitor-forming portion. As a result, according to the invention, it is possible to adjust the magnitude of capacitive coupling between the first and second resonators that are not adjacent to each other while reducing the magnitude of capacitive coupling between the first and third resonators and the magnitude of capacitive coupling between the second and third resonators generated by the conductor layer for capacitive coupling. As a result, according to the invention, it is easy to adjust the characteristics of a layered high frequency filter incorporating at least three resonators.

Other and further objects, features and advantages of the invention will appear more fully from the following description.

DETAILED DESCRIPTION OF PREFERRED EMBODIMENTS

First Embodiment

Figure 1:
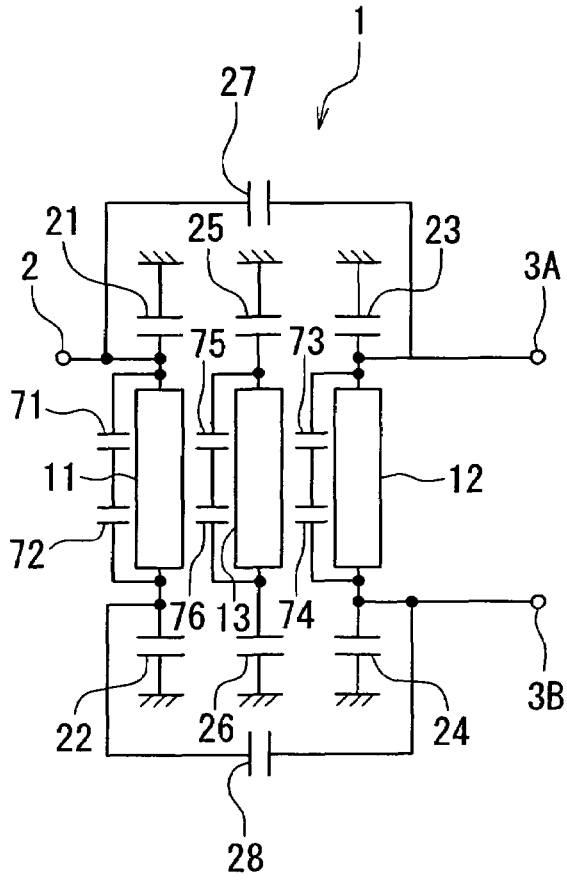
FIG. 1 is a schematic diagram illustrating the circuit configuration of a high frequency filter of a first embodiment of the invention.
Figure 2:
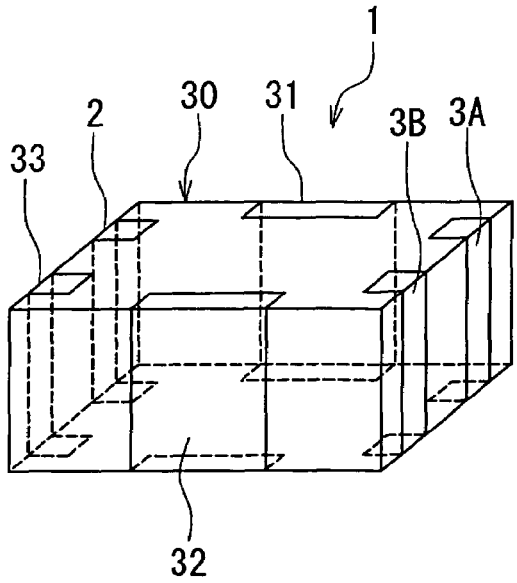
FIG. 2 is a perspective view illustrating an appearance of the high frequency filter of the first embodiment of the invention.
Figure 3:
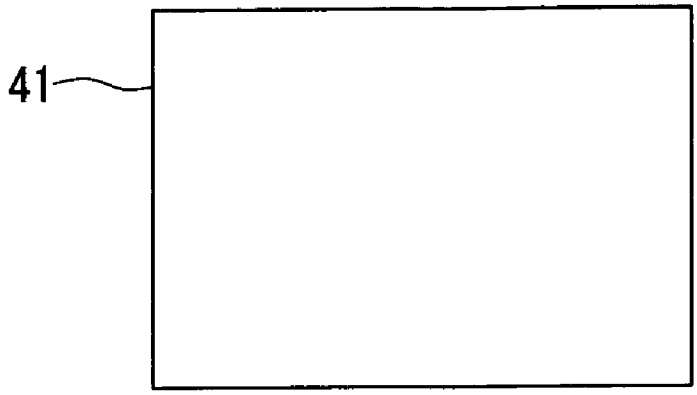
FIG. 3 is a top view of the top surface of a first dielectric layer of the layered substrate of FIG. 2.

Preferred embodiments of the invention will now be described in detail with reference to the accompanying drawings. Reference is now made to FIG. 1 and FIG. 2 to describe the configuration of a high frequency filter of a first embodiment of the invention. FIG. 1 is a schematic diagram illustrating the circuit configuration of the high frequency filter of the first embodiment. FIG. 2 is a perspective view illustrating an appearance of the high frequency filter of the first embodiment.

As shown in FIG. 1, the high frequency filter 1 of the first embodiment incorporates: one unbalanced input/output terminal 2 for receiving or outputting unbalanced signals; two balanced input/output terminals 3A and 3B for receiving or outputting balanced signals; and resonators 11, 12 and 13 each of which comprises a TEM line. The resonators 11, 12 and 13 are provided between the unbalanced input/output terminal 2 and the balanced input/output terminals 3A and 3B for the sake of the circuit configuration. The TEM line is a transmission line for transmitting transverse electromagnetic (TEM) waves that are electromagnetic waves whose electric field and magnetic field exist only in a cross section orthogonal to the direction of travel of the electromagnetic waves.

Each of the resonators 11, 12 and 13 is a half-wave resonator with open ends, and has a shape that is long in one direction. The resonator 13 is disposed between the resonators 11 and 12. The resonators 11, 12 and 13 are disposed in parallel with one another. The adjacent resonators 11 and 13 are inductively coupled to each other. The adjacent resonators 12 and 13 are inductively coupled to each other, too. The resonators 11, 12 and 13 respectively correspond to the first, second and third resonators of the invention.

The high frequency filter 1 further incorporates: a capacitor 21 provided between one of the ends of the resonator 11 and the ground; a capacitor 22 provided between the other of the ends of the resonator 11 and the ground; a capacitor 23 provided between one of the ends of the resonator 12 and the ground; a capacitor 24 provided between the other of the ends of the resonator 12 and the ground; a capacitor 25 provided between one of the ends of the resonator 13 and the ground; a capacitor 26 provided between the other of the ends of the resonator 13 and the ground.

The high frequency filter 1 further incorporates: a capacitor 27 provided between the one of the ends of the resonator 11 and the one of the ends of the resonator 12; and a capacitor 28 provided between the other of the ends of the resonator 11 and the other of the ends of the resonator 12.

The high frequency filter 1 further incorporates: capacitors 71 and 72 provided between the one of the ends of the resonator 11 and the other of the ends of the resonator 11; capacitors 73 and 74 provided between the one of the ends of the resonator 12 and the other of the ends of the resonator 12; and capacitors 75 and 76 provided between the one of the ends of the resonator 13 and the other of the ends of the resonator 13. The capacitors 71 and 72 are connected to each other in series. The capacitors 73 and 74 are connected to each other in series. The capacitors 75 and 76 are connected to each other in series.

It is possible to regard the midpoint between the capacitors 71 and 72 as the ground in terms of potential at a resonant frequency of the resonator 11. Similarly, it is possible to regard the midpoint between the capacitors 73 and 74 as the ground in terms of potential at a resonant frequency of the resonator 12. It is possible to regard the midpoint between the capacitors 75 and 76 as the ground in terms of potential at a resonant frequency of the resonator 13.

The capacitors 21, 22, 71 and 72 are provided for purposes such as adjustment of the resonant frequency of the resonator 11. Similarly, the capacitors 23, 24, 73 and 74 are provided for purposes such as adjustment of the resonant frequency of the resonator 12. The capacitors 25, 26, 75 and 76 are provided for purposes such as adjustment of the resonant frequency of the resonator 13.

As shown in FIG. 2, the high frequency filter 1 further incorporates a layered substrate 30 for integrating components of the high frequency filter 1. The layered substrate 30 includes dielectric layers and conductor layers alternately stacked, which will be described in detail later. Each of the resonators 11, 12 and 13 is formed using at least one of the conductor layers inside the layered substrate 30. The resonators 11, 12 and 13 are distributed constant lines. The capacitors 21 to 28 and 71 to 76 are formed using the conductor layers and the dielectric layers inside the layered substrate 30.

The adjacent resonators 11 and 13 are inductively coupled to each other. The adjacent resonators 12 and 13 are inductively coupled to each other, too. The resonators 11 and 12 are capacitively coupled to each other through the capacitors 27 and 28. The resonators 11, 12 and 13 form a band-pass filter that selectively allows signals at frequencies within a specific frequency band to pass. The frequency of two attenuation poles and the pass band width of the band-pass filter are adjustable by adjusting the magnitude of inductive coupling between the resonators 11 and 13, the magnitude of inductive coupling between the resonators 12 and 13, and the magnitude of capacitive coupling between the resonators 11 and 12.

The operation of the high frequency filter 1 of the embodiment will now be described. If unbalanced signals are inputted to the unbalanced input/output terminal 2 of the high frequency filter 1, signals at frequencies within a specific frequency band among these unbalanced signals are selectively allowed to pass through the band-pass filter formed of the resonators 11, 12 and 13. There is a 180-degree difference in phase of the electric field between one half portion and the other half portion of each of the resonators 11, 12 and 13 along the longitudinal direction. Consequently, voltages outputted from the balanced input/output terminals 3A and 3B are 180-degree out of phase with each other. Therefore, balanced signals are outputted from the balanced input/output terminals 3A and 3B. On the contrary, if balanced signals are inputted to the balanced input/output terminals 3A and 3B, signals at frequencies within a specific frequency band among these balanced signals are selectively allowed to pass through the band-pass filter formed of the resonators 11, 12 and 13, and unbalanced signals are outputted from the unbalanced input/output terminal 2. As thus described, the high frequency filter 1 of the embodiment has both a function of a band-pass filter and a function of a balun.

Reference is now made to FIG. 2 to FIG. 17 to describe the configuration of the layered substrate 30 in detail. As shown in FIG. 2, the layered substrate 30 has a shape of rectangular solid having a top surface, a bottom surface, and four side surfaces. On the top surface, the side surfaces and the bottom surface of the layered substrate 30, there are disposed the terminals 2, 3A, 3B, two ground terminals 31 and 32, and a terminal 33. The terminal 33 is connected to neither the conductor layers inside the layered substrate 30 nor external circuits.

Figure 15:
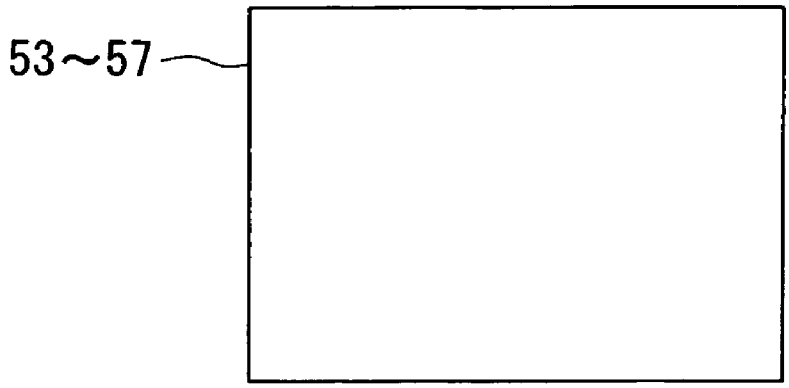
FIG. 15 is a top view representatively illustrating the top surfaces of thirteenth to seventeenth dielectric layers of the layered substrate of FIG. 2.
Figure 16:
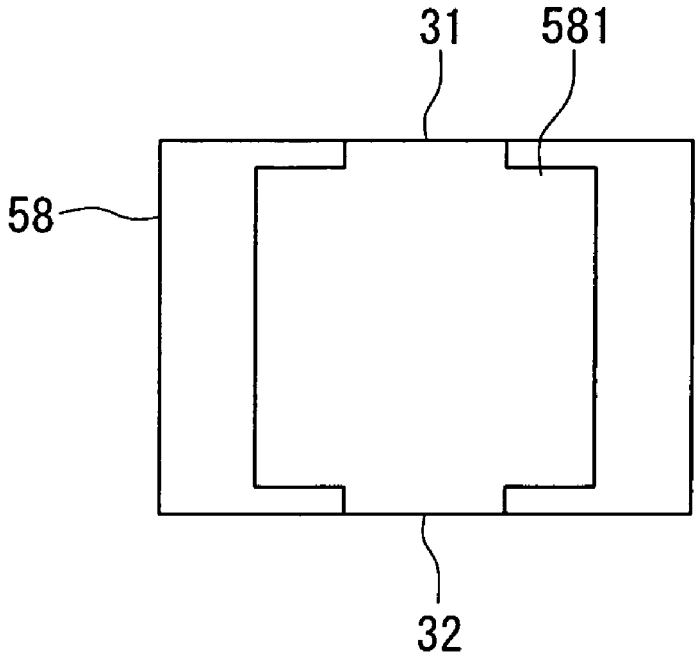
FIG. 16 is a top view of the top surface of an eighteenth dielectric layer of the layered substrate of FIG. 2.
Figure 17:
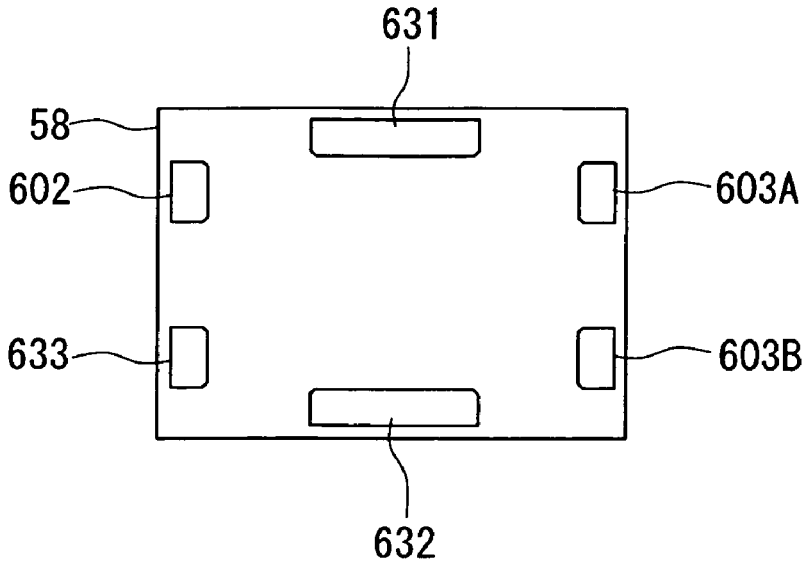
FIG. 17 is a top view of the top surface of the eighteenth dielectric layer and a conductor layer therebelow of the layered substrate of FIG. 2.
Figure 18:
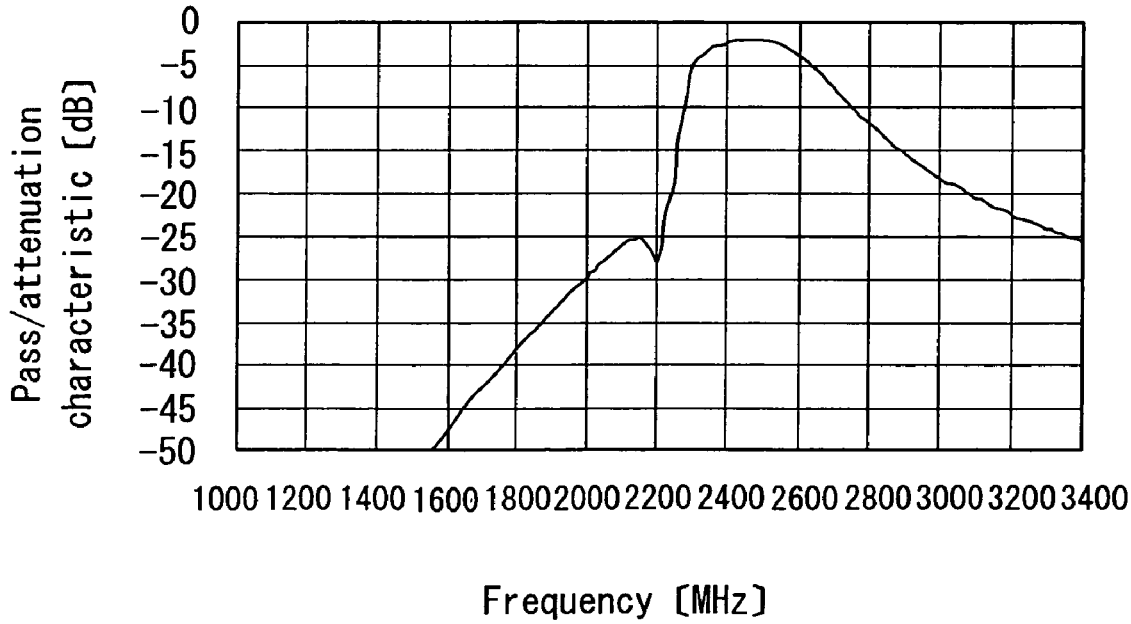
FIG. 18 is a plot showing a result of a simulation performed for confirming an effect of the high frequency filter of the first embodiment of the invention.
Figure 19:
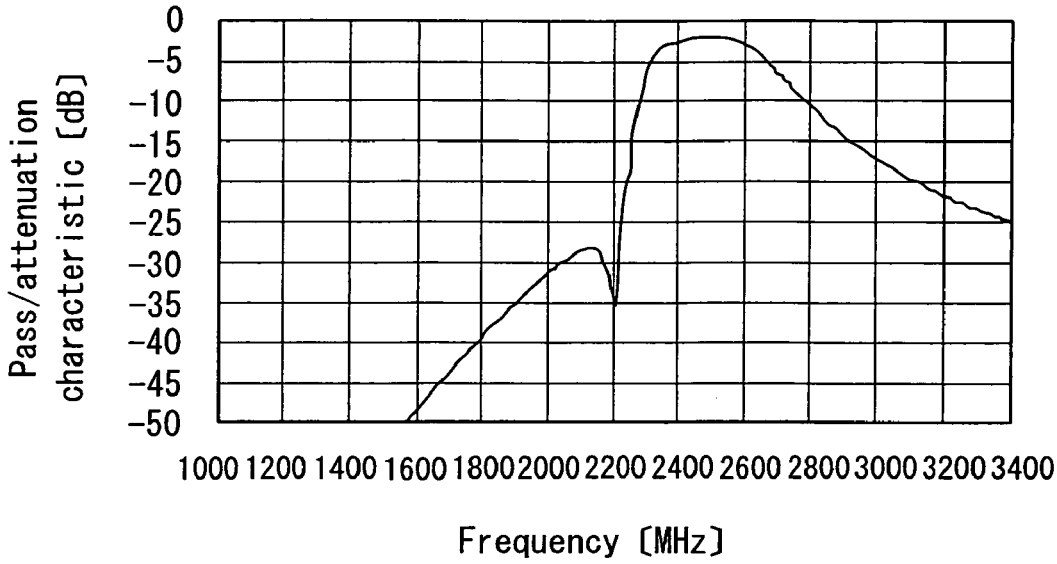
FIG. 19 is a plot showing a result of the simulation performed for confirming the effect of the high frequency filter of the first embodiment of the invention.
Figure 20:
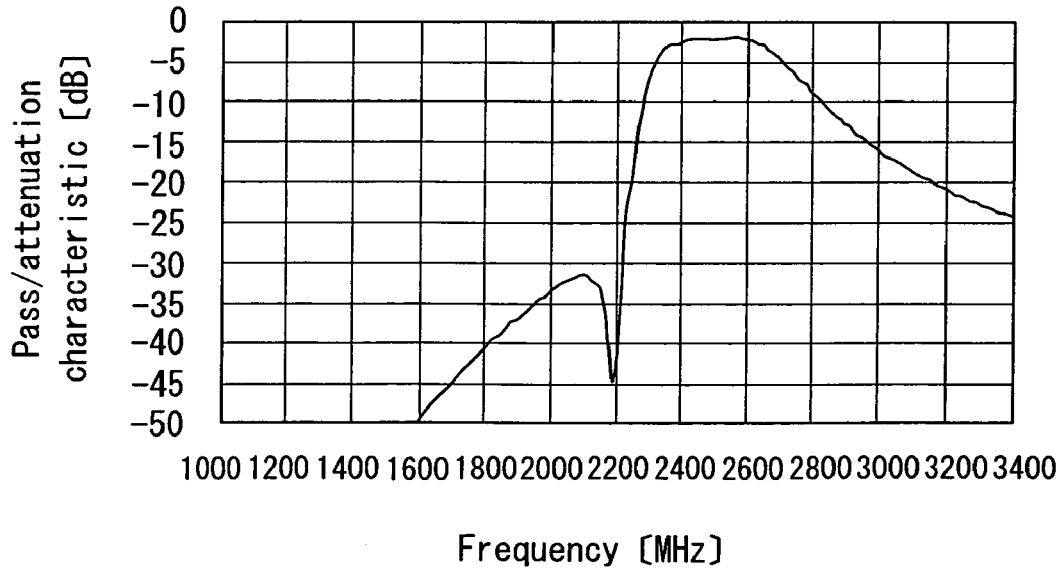
FIG. 20 is a plot showing a result of the simulation performed for confirming the effect of the high frequency filter of the first embodiment of the invention.
Figure 21:
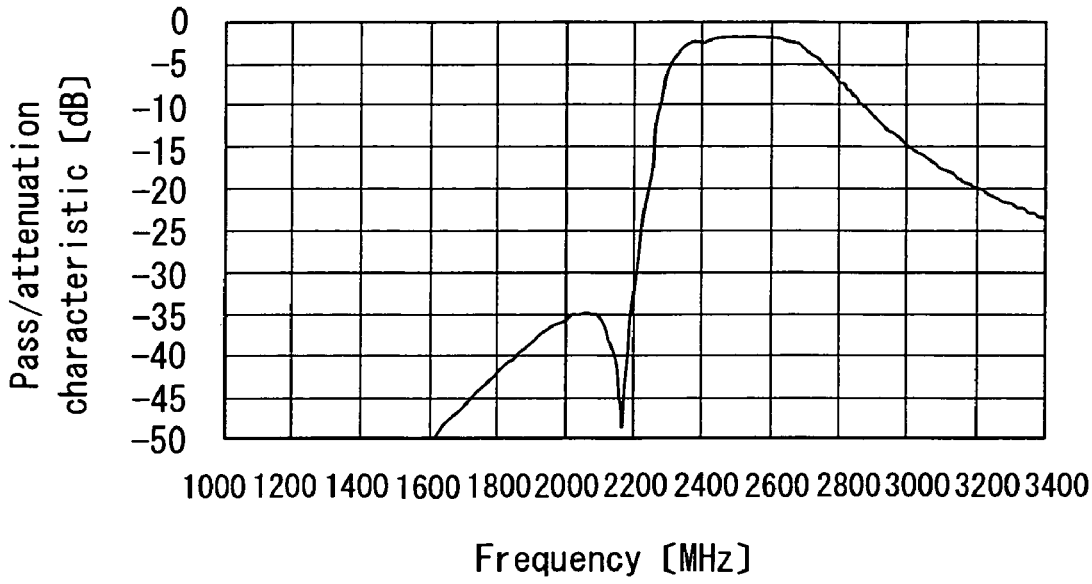
FIG. 21 is a plot showing a result of the simulation performed for confirming the effect of the high frequency filter of the first embodiment of the invention.

FIG. 3 to FIG. 14 respectively illustrate the top surfaces of the first dielectric layer to the twelfth dielectric layer from the top. FIG. 15 is a view representatively illustrating the top surfaces of thirteenth to seventeenth dielectric layers from the top. FIG. 16 illustrates the top surface of the eighteenth dielectric layer from the top. FIG. 17 illustrates the eighteenth dielectric layer and a conductor layer therebelow seen from above. No conductor layer is formed on the top surface of the first dielectric layer 41 of FIG. 3.

Figure 4:
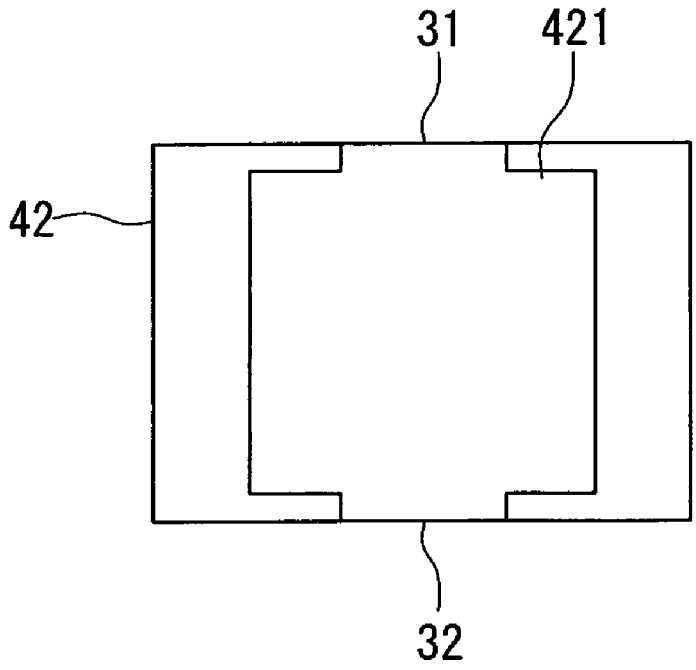
FIG. 4 is a top view of the top surface of a second dielectric layer of the layered substrate of FIG. 2.

A conductor layer 421 for grounding is formed on the top surface of the second dielectric layer 42 of FIG. 4. The conductor layer 421 is connected to the ground terminals 31 and 32.

Figure 5:
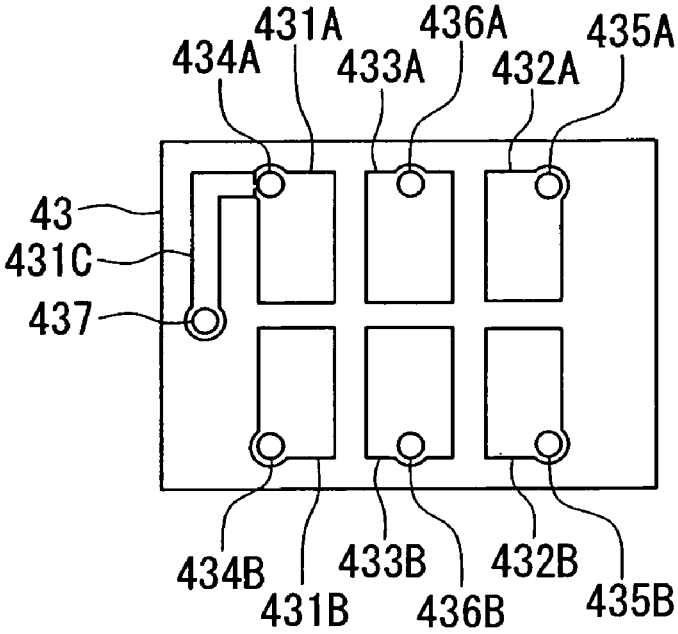
FIG. 5 is a top view of the top surface of a third dielectric layer of the layered substrate of FIG. 2.

Conductor layers 431A, 431B, 432A, 432B, 433A and 433B for electrodes and a conductor layer 431C are formed on the top surface of the third dielectric layer 43 of FIG. 5. An end of the conductor layers 431C is connected to the conductor layer 431A.

The dielectric layer 43 has: through holes 434A, 434B, 435A, 435B, 436A and 436B connected to the conductor layers 431A, 431B, 432A, 432B, 433A and 433B, respectively; and a through hole 437 connected to the other end of the conductor layer 431C.

The conductor layers 431A, 431B, 432A, 432B, 433A and 433B are opposed to the conductor layer 421 of FIG. 4 with the dielectric layer 42 of FIG. 4 disposed in between. The capacitor 21 of FIG. 1 is formed of the conductor layers 431A and 421 and the dielectric layer 42. The capacitor 22 of FIG. 1 is formed of the conductor layers 431B and 421 and the dielectric layer 42. The capacitor 23 of FIG. 1 is formed of the conductor layers 432A and 421 and the dielectric layer 42. The capacitor 24 of FIG. 1 is formed of the conductor layers 432B and 421 and the dielectric layer 42. The capacitor 25 of FIG. 1 is formed of the conductor layers 433A and 421 and the dielectric layer 42. The capacitor 26 of FIG. 1 is formed of the conductor layers 433B and 421 and the dielectric layer 42.

Figure 6:
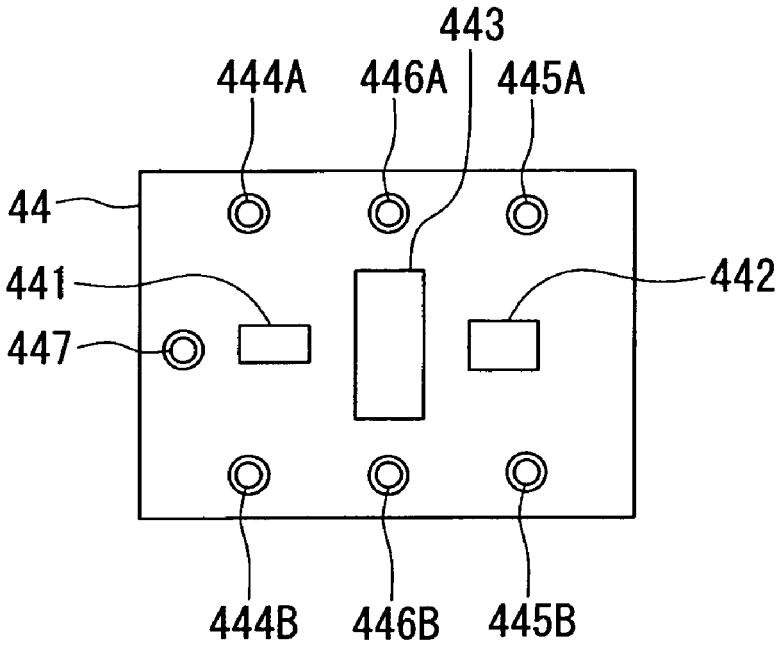
FIG. 6 is a top view of the top surface of a fourth dielectric layer of the layered substrate of FIG. 2.

Conductor layers 441, 442 and 443 are formed on the top surface of the fourth dielectric layer 44 of FIG. 6. The conductor layer 441 is opposed to the conductor layers 431A and 431B of FIG. 5 with the dielectric layer 43 of FIG. 5 disposed in between. The conductor layer 442 is opposed to the conductor layers 432A and 432B of FIG. 5 with the dielectric layer 43 of FIG. 5 disposed in between. The conductor layer 443 is opposed to the conductor layers 433A and 433B of FIG. 5 with the dielectric layer 43 of FIG. 5 disposed in between.

The dielectric layer 44 has: through holes 444A, 444B, 445A, 445B, 446A, 446B and 447. The through holes 434A, 434B, 435A, 435B, 436A, 436B and 437 of FIG. 5 are connected to the through holes 444A, 444B, 445A, 445B, 446A, 446B and 447, respectively.

Figure 7:
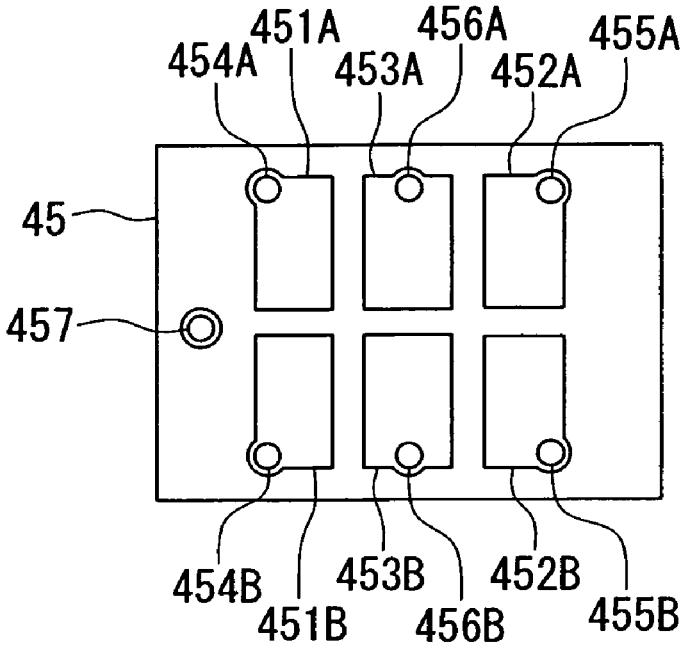
FIG. 7 is a top view of the top surface of a fifth dielectric layer of the layered substrate of FIG. 2.

Conductor layers 451A, 451B, 452A, 452B, 453A and 453B for electrodes are formed on the top surface of the fifth dielectric layer 45 of FIG. 7. The conductor layers 451A, 451B, 452A, 452B, 453A and 453B are respectively opposed to the conductor layers 431A, 431B, 432A, 432B, 433A and 433B of FIG. 5.

The dielectric layer 45 has: through holes 454A, 454B, 455A, 455B, 456A and 456B that are connected to the conductor layers 451A, 451B, 452A, 452B, 453A and 453B, respectively; and a through hole 457. The through holes 444A, 444B, 445A, 445B, 446A, 446B and 447 of FIG. 6 are connected to the through holes 454A, 454B, 455A, 455B, 456A, 456B and 457, respectively.

The conductor layer 441 of FIG. 6 is opposed to the conductor layers 451A and 451B of FIG. 7 with the dielectric layer 44 of FIG. 6 disposed in between. The conductor layer 442 of FIG. 6 is opposed to the conductor layers 452A and 452B of FIG. 7 with the dielectric layer 44 of FIG. 6 disposed in between. The conductor layer 443 of FIG. 6 is opposed to the conductor layers 453A and 453B of FIG. 7 with the dielectric layer 44 of FIG. 6 disposed in between.

The capacitor 71 of FIG. 1 is formed of the conductor layers 431A, 441 and 451A and the dielectric layers 43 and 44. The capacitor 72 of FIG. 1 is formed of the conductor layers 431B, 441 and 451B and the dielectric layers 43 and 44. The capacitor 73 of FIG. 1 is formed of the conductor layers 432A, 442 and 452A and the dielectric layers 43 and 44. The capacitor 74 of FIG. 1 is formed of the conductor layers 432B, 442 and 452B and the dielectric layers 43 and 44.

Figure 8:
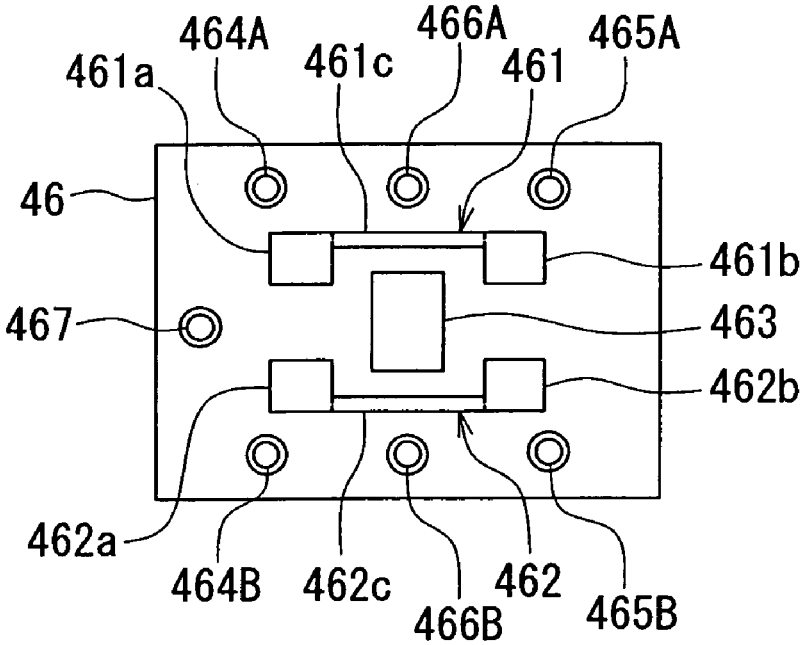
FIG. 8 is a top view of the top surface of a sixth dielectric layer of the layered substrate of FIG. 2.

Conductor layers 461 and 462 for capacitive coupling and a conductor layer 463 are formed on the top surface of the sixth dielectric layer 46 of FIG. 8. The conductor layer 461 has: a first portion 461*a* for forming a capacitor between itself and the resonator 11; a second portion 461*b* for forming a capacitor between itself and the resonator 12; and a third portion 461*c* having an end connected to the first portion 461*a* and the other end connected to the second portion 461*b*, the ends being opposed to each other in the longitudinal direction. The conductor layer 462 has: a first portion 462*a* for forming a capacitor between itself and the resonator 11; a second portion 462*b* for forming a capacitor between itself and the resonator 12; and a third portion 462*c* having an end connected to the first portion 462*a* and the other end connected to the second portion 462*b*, the ends being opposed to each other in the longitudinal direction.

The first portion 461*a*, the second portion 461*b* and the third portion 461*c* of the conductor layer 461 are respectively opposed to the conductor layers 451A, 452A and 453A of FIG. 7 with the dielectric layer 45 of FIG. 7 disposed in between. Similarly, the first portion 462*a*, the second portion 462*b* and the third portion 462*c* of the conductor layer 462 are respectively opposed to the conductor layers 451B, 452B and 453B of FIG. 7 with the dielectric layer 45 of FIG. 7 disposed in between. The conductor layer 463 is opposed to the conductor layers 453A and 453B of FIG. 7 with the dielectric layer 45 of FIG. 7 disposed in between.

In the conductor layer 461 the width of the third portion 461*c* is smaller than the width of each of the first portion 461*a* and the second portion 461*b*. Here, the widths of the first portion 461*a*, the second portion 461*b* and the third portion 461*c* mean the respective lengths of the first portion 461*a*, the second portion 461*b* and the third portion 461*c* taken in the direction that is parallel to the top surface of the conductor layer 461 and that intersects the longitudinal direction of the third portion 461*c* at a right angle.

Similarly, in the conductor layer 462, the width of the third portion 462*c* is smaller than the width of each of the first portion 462*a* and the second portion 462*b*. Here, the widths of the first portion 462*a*, the second portion 462*b* and the third portion 462*c* mean the respective lengths of the first portion 462*a*, the second portion 462*b* and the third portion 462*c* taken in the direction that is parallel to the top surface of the conductor layer 462 and that intersects the longitudinal direction of the third portion 462*c* at a right angle.

The dielectric layer 46 has through holes 464A, 464B, 465A, 465B, 466A, 466B and 467. The through holes 454A, 454B, 455A, 455B, 456A, 456B and 457 of FIG. 7 are connected to the through holes 464A, 464B, 465A, 465B, 466A, 466B and 467, respectively.

Figure 9:
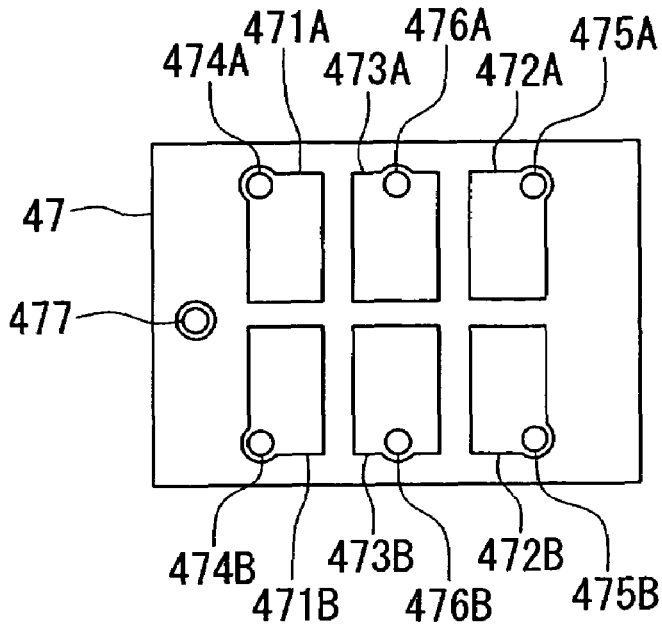
FIG. 9 is a top view of the top surface of a seventh dielectric layer of the layered substrate of FIG. 2.

Conductor layers 471A, 471B, 472A, 472B, 473A and 473B for electrodes are formed on the top surface of the seventh dielectric layer 47 of FIG. 9. The conductor layers 471A, 471B, 472A, 472B, 473A and 473B are respectively opposed to the conductor layers 451A, 451B, 452A, 452B, 453A and 453B of FIG. 7.

The first portion 461*a*, the second portion 461*b* and the third portion 461*c* of the conductor layer 461 shown in FIG. 8 are respectively opposed to the conductor layers 471A, 472A and 473A of FIG. 9 with the dielectric layer 46 of FIG. 9 disposed in between. Similarly, the first portion 462*a*, the second portion 462*b* and the third portion 462*c* of the conductor layer 462 shown in FIG. 8 are respectively opposed to the conductor layers 471B, 472B and 473B of FIG. 9 with the dielectric layer 46 disposed in between. The conductor layer 463 of FIG. 8 is opposed to the conductor layers 473A and 473B of FIG. 9 with the dielectric layer 46 disposed in between.

The capacitor 75 of FIG. 1 is formed of the conductor layers 433A, 443, 453A, 463 and 473A and the dielectric layers 43, 44, 45 and 46. The capacitor 76 of FIG. 1 is formed of the conductor layers 433B, 443, 453B, 463 and 473B and the dielectric layers 43, 44, 45 and 46.

The dielectric layer 47 of FIG. 9 has: through holes 474A, 474B, 475A, 475B, 476A and 476B that are connected to the conductor layers 471A, 471B, 472A, 472B, 473A and 473B, respectively; and a through hole 477. The through holes 464A, 464B, 465A, 465B, 466A, 466B and 467 of FIG. 8 are connected to the through holes 474A, 474B, 475A, 475B, 476A, 476B and 477, respectively.

As shown in FIG. 7 to FIG. 9, the first portion 461*a* of the conductor layer 461 is opposed to the conductor layer 451A with the dielectric layer 45 disposed in between, and opposed to the conductor layer 471A with the dielectric layer 46 disposed in between. A capacitor corresponding to the first capacitor of the invention is formed of the first portion 461*a*, the conductor layers 451A and 471A, and the dielectric layers 45 and 46. In addition, the second portion 461*b* of the conductor layer 461 is opposed to the conductor layer 452A with the dielectric layer 45 disposed in between, and opposed to the conductor layer 472A with the dielectric layer 46 disposed in between. A capacitor corresponding to the second capacitor of the invention is formed of the second portion 461*b*, the conductor layers 452A and 472A, and the dielectric layers 45 and 46. The capacitor formed of the first portion 461*a*, the conductor layers 451A and 471A and the dielectric layers 45 and 46 is connected in series to the capacitor formed of the second portion 461*b*, the conductor layers 452A and 472A and the dielectric layers 45 and 46. These two capacitors constitute the capacitor 27 of FIG. 1.

Similarly, the first portion 462*a* of the conductor layer 462 is opposed to the conductor layer 451B with the dielectric layer 45 disposed in between, and opposed to the conductor layer 471B with the dielectric layer 46 disposed in between. A capacitor corresponding to the first capacitor of the invention is formed of the first portion 462*a*, the conductor layers 451B and 471B, and the dielectric layers 45 and 46. In addition, the second portion 462*b* of the conductor layer 462 is opposed to the conductor layer 452B with the dielectric layer 45 disposed in between, and opposed to the conductor layer 472B with the dielectric layer 46 disposed in between. A capacitor corresponding to the second capacitor of the invention is formed of the second portion 462*b*, the conductor layers 452B and 472B, and the dielectric layers 45 and 46. The capacitor formed of the first portion 462*a*, the conductor layers 451B and 471B and the dielectric layers 45 and 46 is connected in series to the capacitor formed of the second portion 462*b*, the conductor layers 452B and 472B and the dielectric layers 45 and 46. These two capacitors constitute the capacitor 28 of FIG. 1.

Figure 10:
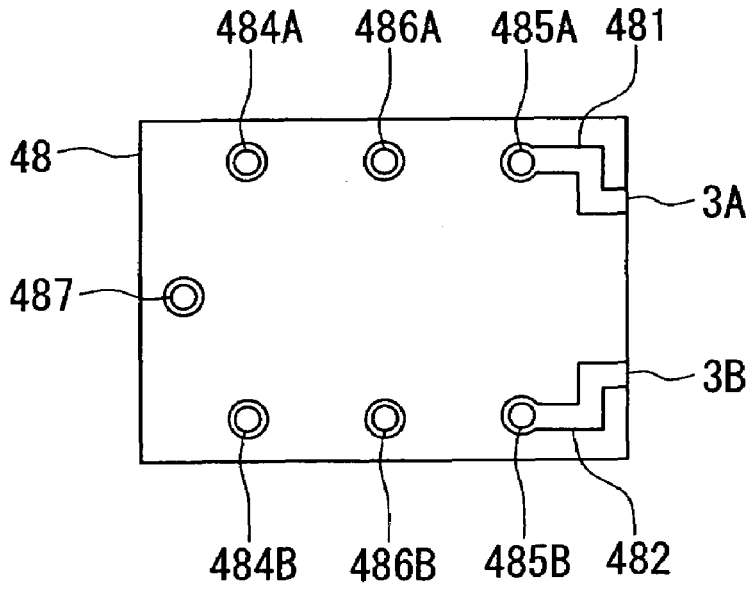
FIG. 10 is a top view of the top surface of an eighth dielectric layer of the layered substrate of FIG. 2.

Conductor layers 481 and 482 are formed on the top surface of the eighth dielectric layer 48 of FIG. 10. An end of the conductor layer 481 is connected to the balanced input/output terminal 3A. An end of the conductor layer 482 is connected to the balanced input/output terminal 3B. The dielectric layer 48 has through holes 484A, 484B, 485A, 485B, 486A, 486B and 487. The through hole 485A is connected to the other end of the conductor layer 481. The through hole 485B is connected to the other end of the conductor layer 482. The through holes 474A, 474B, 475A, 475B, 476A, 476B and 477 of FIG. 9 are respectively connected to the through holes 484A, 484B, 485A, 485B, 486A, 486B and 487.

Figure 11:
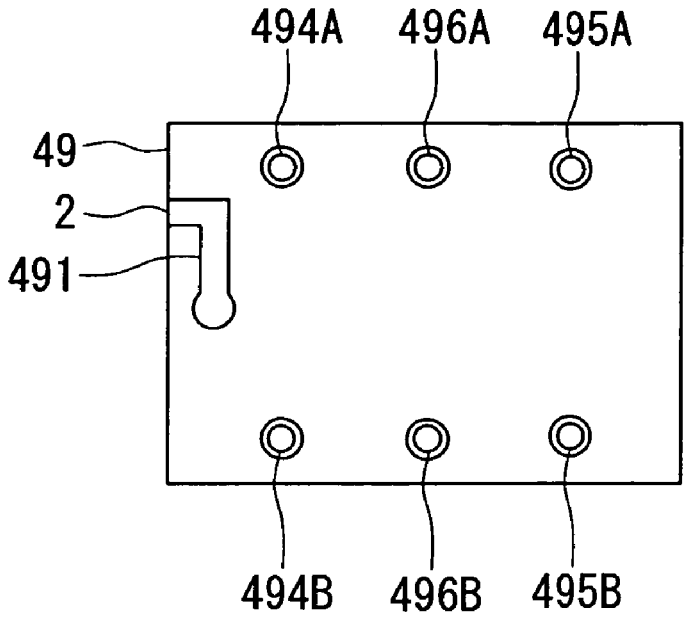
FIG. 11 is a top view of the top surface of a ninth dielectric layer of the layered substrate of FIG. 2.

A conductor layer 491 is formed on the top surface of the ninth dielectric layer 49 of FIG. 11. An end of the conductor layer 491 is connected to the unbalanced input/output terminal 2. The dielectric layer 49 has through holes 494A, 494B, 495A, 495B, 496A and 496B. The through holes 484A, 484B, 485A, 485B, 486A and 486B of FIG. 10 are respectively connected to the through holes 494A, 494B, 495A, 495B, 496A and 496B. The through hole 487 of FIG. 10 is connected to the conductor layer 491.

Figure 12:
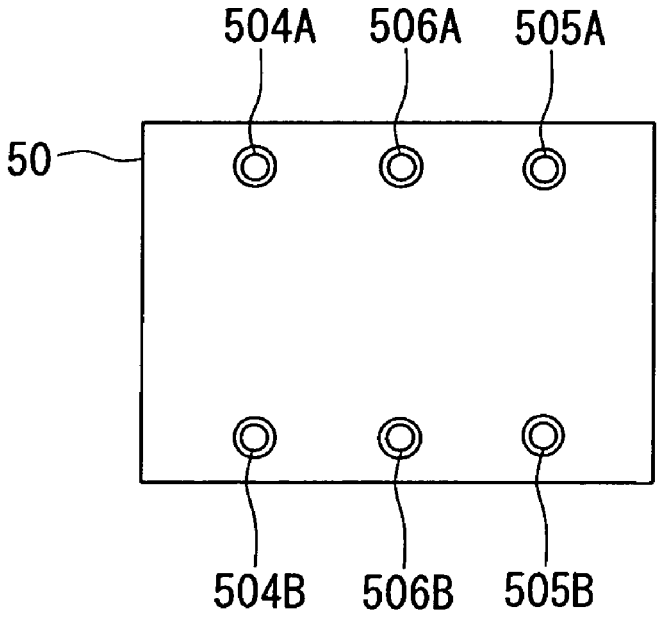
FIG. 12 is a top view of the top surface of a tenth dielectric layer of the layered substrate of FIG. 2.

The tenth dielectric layer 50 of FIG. 12 has through holes 504A, 504B, 505A, 505B, 506A and 506B. The through holes 494A, 494B, 495A, 495B, 496A and 496B of FIG. 11 are respectively connected to the through holes 504A, 504B, 505A, 505B, 506A and 506B.

Figure 13:
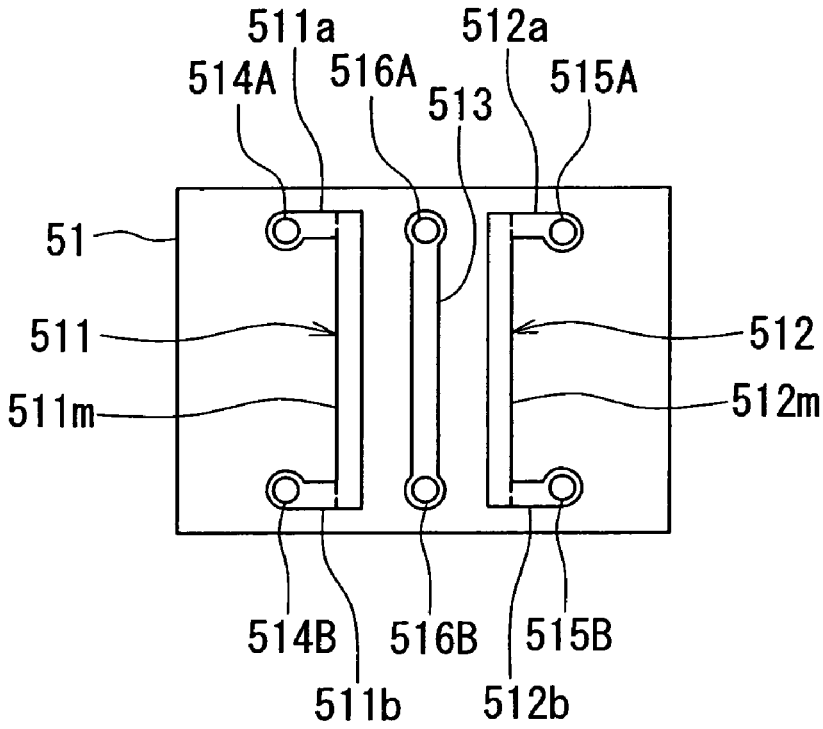
FIG. 13 is a top view of the top surface of an eleventh dielectric layer of the layered substrate of FIG. 2.

Conductor layers 511, 512 and 513 for resonators are formed on the top surface of the eleventh dielectric layer 51 of FIG. 13. The conductor layer 511 has: a main part 511*m* that is long in one direction; an arm portion 511*a* formed to extend from an end of the main part 511*m*; and an arm portion 511*b* formed to extend from the other end of the main part 511*m*. The conductor layer 512 has: a main part 512*m* that is long in one direction; an arm portion 512*a* formed to extend from an end of the main part 512*m*; and an arm portion 512*b* formed to extend from the other end of the main part 512*m*. The conductor layer 513 has a shape that is long in one direction. The conductor layers 511, 512 and 513 form respective portions of the resonators 11, 12 and 13.

The main part 511*m*, the conductor layer 513 and the main part 512*m* are disposed in parallel to one another on the same dielectric layer 51. The conductor layer 513 is disposed between the main parts 511*m* and 512*m*. The conductor layers 511 and 513 are inductively coupled to each other. The conductor layers 512 and 513 are inductively coupled to each other, too.

The dielectric layer 51 has through holes 514A, 514B, 515A, 515B, 516A and 516B. The through hole 514A is connected to the arm portion 511*a*. The through hole 514B is connected to the arm portion 511*b*. The through hole 515A is connected to the arm portion 512*a*. The through hole 515B is connected to the arm portion 512*b*. The through hole 516A is connected to an end of the conductor layer 513. The through hole 516B is connected to the other end of the conductor layer 513. The through holes 504A, 504B, 505A, 505B, 506A and 506B of FIG. 12 are respectively connected to the through holes 514A, 514B, 515A, 515B, 516A and 516B.

Figure 14:
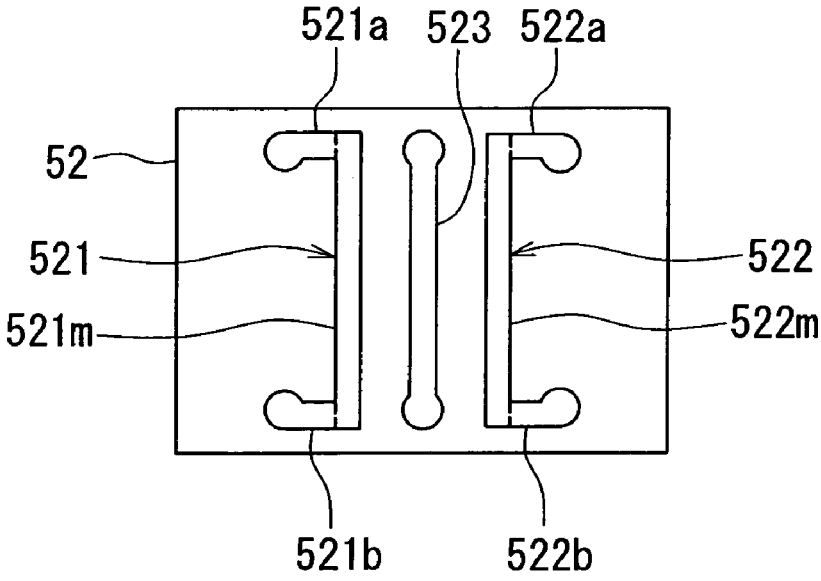
FIG. 14 is a top view of the top surface of a twelfth dielectric layer of the layered substrate of FIG. 2.

Conductor layers 521, 522 and 523 for resonators are formed on the top surface of the twelfth dielectric layer 52 of FIG. 14. The conductor layer 521 has: a main part 521*m* that is long in one direction; an arm portion 521*a* formed to extend from an end of the main part 521*m*; and an arm portion 521*b* formed to extend from the other end of the main part 521*m*. The conductor layer 522 has: a main part 522*m* that is long in one direction; an arm portion 522*a* formed to extend from an end of the main part 522*m*; and an arm portion 522*b* formed to extend from the other end of the main part 522*m*. The conductor layer 523 has a shape that is long in one direction. The conductor layers 521, 522 and 523 form the other respective portions of the resonators 11, 12 and 13.

The main part 521*m*, the conductor layer 523 and the main part 522*m* are disposed in parallel to one another on the same dielectric layer 52. The conductor layer 523 is disposed between the main parts 521*m* and 522*m*. The conductor layers 521 and 523 are inductively coupled to each other. The conductor layers 522 and 523 are inductively coupled to each other, too. The conductor layers 521, 522 and 523 are opposed to the conductor layers 511, 512 and 513 of FIG. 13, respectively, with the dielectric layer 51 of FIG. 13 disposed in between.

The through holes 514A, 514B, 515A and 515B of FIG. 13 are respectively connected to the arm portions 521*a*, 521*b*, 522*a* and 522*b*. The through hole 516A of FIG. 13 is connected to an end of the conductor layer 523. The through hole 516B of FIG. 13 is connected to the other end of the conductor layer 523.

The conductor layers 431A, 451A and 471A are connected to one of the ends of the resonator 11 formed of the conductor layers 511 and 521. Among the conductor layers 431A, 451A and 471A, the conductor layers 451A and 471A correspond to the first electrode of the invention since the conductor layers 451A and 471A are opposed to the first portion 461*a* of the conductor layer 461, with the dielectric layers 45 and 46 respectively disposed in between. Furthermore, the conductor layers 431B, 451B and 471B are connected to the other of the ends of the resonator 11. Among the conductor layers 431B, 451B and 471B, the conductor layers 451B and 471B correspond to the first electrode of the invention since the conductor layers 451B and 471B are opposed to the first portion 462*a* of the conductor layer 462, with the dielectric layers 45 and 46 respectively disposed in between.

The conductor layers 432A, 452A and 472A are connected to one of the ends of the resonator 12 formed of the conductor layers 512 and 522. Among the conductor layers 432A, 452A and 472A, the conductor layers 452A and 472A correspond to the second electrode of the invention since the conductor layers 452A and 472A are opposed to the second portion 461*b* of the conductor layer 461, with the dielectric layers 45 and 46 respectively disposed in between. Furthermore, the conductor layers 432B, 452B and 472B are connected to the other of the ends of the resonator 12. Among the conductor layers 432B, 452B and 472B, the conductor layers 452B and 472B correspond to the second electrode of the invention since the conductor layers 452B and 472B are opposed to the second portion 462*b* of the conductor layer 462, with the dielectric layers 45 and 46 respectively disposed in between.

The conductor layers 433A, 453A and 473A are connected to one of the ends of the resonator 13 formed of the conductor layers 513 and 523. Among the conductor layers 433A, 453A and 473A, the conductor layers 453A and 473A correspond to the third electrode of the invention since the conductor layers 453A and 473A are opposed to the third portion 461*c* of the conductor layer 461, with the dielectric layers 45 and 46 respectively disposed in between. Furthermore, the conductor layers 433B, 453B and 473B are connected to the other of the ends of the resonator 13. Among the conductor layers 433B, 453B and 473B, the conductor layers 453B and 473B correspond to the third electrode of the invention since the conductor layers 453B and 473B are opposed to the third portion 462*c* of the conductor layer 462, with the dielectric layers 45 and 46 respectively disposed in between.

As shown in FIG. 15, no conductor layers are formed on the top surfaces of the thirteenth to seventeenth dielectric layers 53 to 57.

A conductor layer 581 for grounding is formed on the top surface of the eighteenth dielectric layer 58 of FIG. 16. The conductor layer 581 is connected to the ground terminals 31 and 32.

As shown in FIG. 17, conductor layers 602, 603A, 603B, 631, 632 and 633 that are respectively connected to the terminals 2, 3A, 3B, 31, 32 and 33 are formed on the bottom surface of the dielectric layer 58, that is, on the bottom surface of the layered substrate 30.

In the embodiment the layered substrate 30 may be chosen out of a variety of types of substrates, such as one in which the dielectric layers are made of a resin, a ceramic, or a combination of these. However, it is preferred that the layered substrate 30 be a multilayer substrate of low-temperature co-fired ceramic that exhibits an excellent high frequency characteristic.

As described so far, the high frequency filter 1 of the embodiment incorporates the conductor layers 461 and 462 for capacitive coupling that are provided for capacitively coupling the resonators 11 and 12 that are not adjacent to each other. The conductor layer 461 has: the first portion 461*a* for forming a capacitor between itself and the resonator 11; the second portion 461*b* for forming a capacitor between itself and the resonator 12; and the third portion 461*c* having an end connected to the first portion 461*a* and the other end connected to the second portion 461*b*, the ends being opposed to each other in the longitudinal direction. The conductor layer 462 has: the first portion 462*a* for forming a capacitor between itself and the resonator 11; the second portion 462*b* for forming a capacitor between itself and the resonator 12; and the third portion 462*c* having an end connected to the first portion 462*a* and the other end connected to the second portion 462*b*, the ends being opposed to each other in the longitudinal direction.

In the conductor layer 461 the width of the third portion 461*c* is smaller than the width of each of the first portion 461*a* and the second portion 461*b*. As a result, according to the embodiment, it is possible to make the capacitance generated between the third portion 461*c* and the resonator 13 smaller, compared with the case in which the width of the third portion 461*c* is equal to or greater than the width of each of the first portion 461*a* and the second portion 461*b*. In the example of FIG. 8 the width of the entire third portion 461*c* is smaller than the width of each of the first portion 461*a* and the second portion 461*b*. In the embodiment, however, it suffices that at least part of the third portion 461*c*, particularly a part thereof opposed to the conductor layers 453A and 473A, is smaller in width than each of the first portion 461*a* and the second portion 461*b*. The above-mentioned effect is thereby obtained.

Similarly, in the conductor layer 462, the width of the third portion 462*c* is smaller than the width of each of the first portion 462*a* and the second portion 462*b*. As a result, according to the embodiment, it is possible to make the capacitance generated between the third portion 462*c* and the resonator 13 smaller, compared with the case in which the width of the third portion 462*c* is equal to or greater than the width of each of the first portion 462*a* and the second portion 462*b*. In the example of FIG. 8 the width of the entire third portion 462*c* is smaller than the width of each of the first portion 462*a* and the second portion 462*b*. In the embodiment, however, it suffices that at least part of the third portion 462*c*, particularly a part thereof opposed to the conductor layers 453B and 473B, is smaller in width than each of the first portion 462*a* and the second portion 462*b*. The above-mentioned effect is thereby obtained.

From the foregoing, according to the embodiment, it is possible to adjust the magnitude of capacitive coupling between the resonators 11 and 12 that are not adjacent to each other while reducing the magnitude of capacitive coupling between the resonators 11 and 13 and the magnitude of capacitive coupling between the resonators 12 and 13 generated by the conductor layers 461 and 462. As a result, according to the embodiment, it is easy to adjust the characteristics of the high frequency filter 1.

In the high frequency filter 1 of the embodiment, each of the method of coupling the adjacent resonators 11 and 13 to each other and the method of coupling the adjacent resonators 12 and 13 to each other is chiefly inductive coupling. In this case, as can be seen from the results of simulation that will be described later, it is possible to increase the pass-band width of the band-pass filter and to increase the attenuation outside the pass band by reducing the magnitude of capacitive coupling between the adjacent resonators 11 and 13 and the magnitude of capacitive coupling between the adjacent resonators 12 and 13 as described above.

It is preferred that, in the conductor layer 461, the width of at least part of the third portion 461*c* be equal to or smaller than a half of the width of the first portion 461*a* and equal to or smaller than a half of the width of the second portion 461*b*. Similarly, it is preferred that, in the conductor layer 462, the width of at least part of the third portion 462*c* be equal to or smaller than a half of the width of the first portion 462*a* and equal to or smaller than a half of the width of the second portion 462*b*. The reason will be described later, referring to the results of the simulation.

In the embodiment, the capacitors 21 to 26 are provided between the ground and the respective ends of the resonators 11 to 13. As a result, according to the embodiment, it is possible to make the physical length of each of the resonators 11 to 13 smaller than a half of the wavelength corresponding to the center frequency of the pass band of the band-pass filter. It is thereby possible to reduce the size of the high frequency filter 1.

The results of the simulation performed to confirm the effect of the high frequency filter 1 of the embodiment will now be described. Used for the simulation were first to fourth models of the high frequency filter 1 that were designed so that the pass band width of the band-pass filter be approximately 2400 to 2500 MHz. The pass band width of 2400 to 2500 MHz corresponds to the pass band width of band-pass filters used in communications apparatuses conforming to the Bluetooth standard and those for use on a wireless LAN.

For each of the first to fourth models, the width of each of the first portion 461*a* and the second portion 461*b* of the conductor layer 461 and the first portion 462*a* and the second portion 462*b* of the conductor layer 462 was set to be 175 μm. For the first model, the width of each of the third portion 461*c* of the conductor layer 461 and the third portion 462*c* of the conductor layer 462 was made equal to the above-mentioned width of each of the first portions 461*a* and 462*a* and the second portions 461*b* and 462*b*. For the second model, the width of each of the third portions 461*c* and 462*c* was set to be three fourths of the above-mentioned width of each of the first portions 461*a* and 462*a* and the second portions 461*b* and 462*b*. For the third model, the width of each of the third portions 461*c* and 462*c* was set to be a half of the above-mentioned width of each of the first portions 461*a* and 462*a* and the second portions 461*b* and 462*b*. For the fourth model, the width of each of the third portions 461*c* and 462*c* was set to be 50 μm, which is two sevenths of the above-mentioned width of each of the first portions 461*a* and 462*a* and the second portions 461*b* and 462*b*.

FIG. 18 to FIG. 21 are plots respectively showing pass and attenuation characteristics of the first to fourth models obtained by the simulation. As can be seen from comparison among FIG. 18 to FIG. 21, as the width of each of the third portions 461*c* and 462*c* is reduced, the attenuation pole of the band-pass filter becomes more abrupt, the pass band width becomes greater, and the attenuation outside the pass band becomes greater. Therefore, it is preferred that the width of each of the third portions 461*c* and 462*c* be as small as possible to make the attenuation pole of the band-pass filter more abrupt, increase the pass band width, and increase the attenuation outside the pass band.

As can be seen from comparison among FIG. 18 to FIG. 21, when the width of each of the third portions 461*c* and 462*c* is equal to or smaller than a half of the width of each of the first portions 461*a* and 462*a* and the second portions 461*b* and 462*b*, such an effect that the attenuation pole becomes more abrupt, the pass band width increases and the attenuation outside the pass band increases as described above is noticeable. Therefore, it is preferred that the width of at least part of each of the third portions 461*c* and 462*c* be equal to or smaller than a half of the width each of the first portions 461*a* and 462*a* and the second portions 461*b* and 462*b*.

When designing the high frequency filter 1 so that the pass band width of the band-pass filter be 1920 to 2170 MHz, which is a frequency band used for cellular phones of the wideband code division multiple access (W-CDMA) system, achieving an attenuation of 30 dB or greater outside this frequency band requires that the width of at least part of each of the third portions 461*c* and 462*c* be equal to or smaller than a half of the width of each of the first portions 461*a* and 462*a* and the second portions 461*b* and 462*b*.

In terms of manufacturing techniques, there is limitation to a reduction in the width of at least part of each of the third portions 461*c* and 462*c*. Considering the current state of the art, the width of at least part of each of the third portions 461*c* and 462*c* is preferably 56 μm or greater.

Second Embodiment

Figure 22:
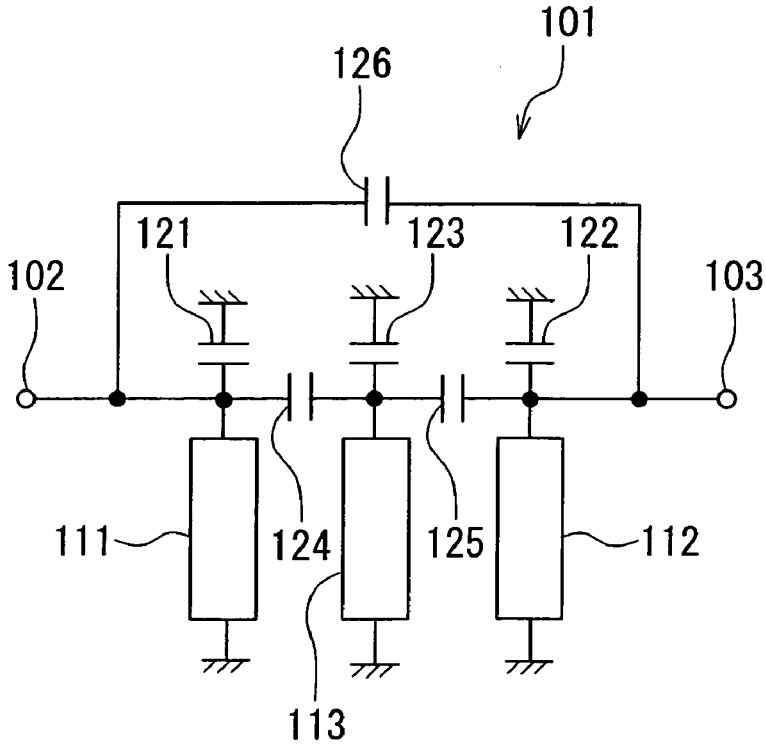
FIG. 22 is a schematic diagram illustrating the circuit configuration of a high frequency filter of a second embodiment of the invention.
Figure 23:
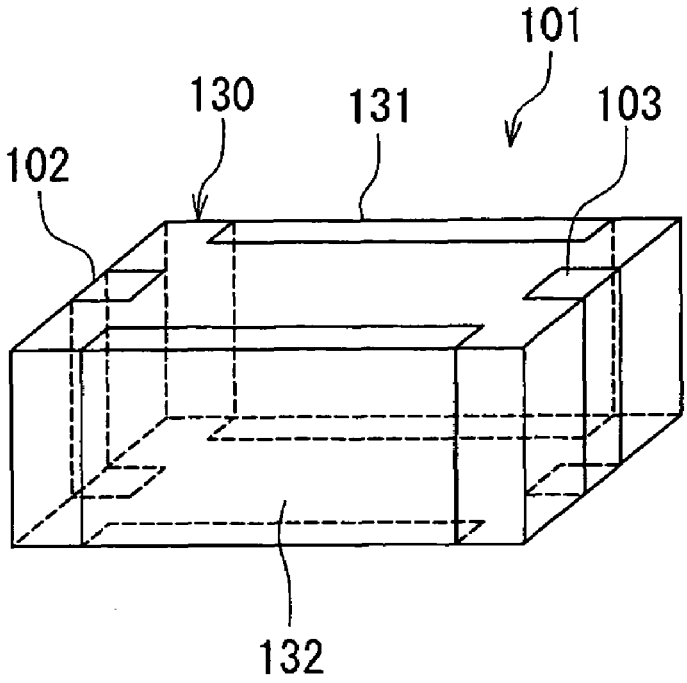
FIG. 23 is a perspective view illustrating an appearance of the high frequency filter of the second embodiment of the invention.
Figure 24:
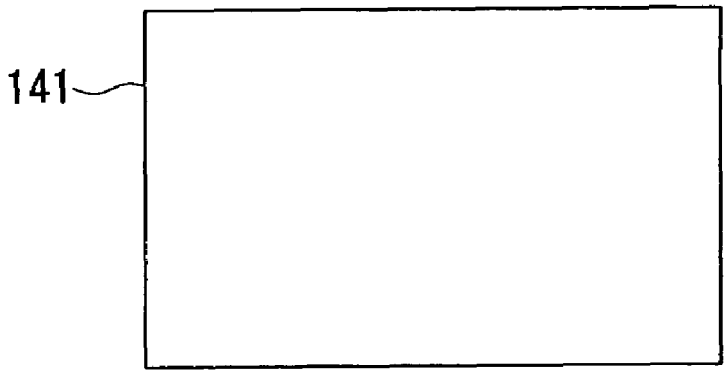
FIG. 24 is a top view of the top surface of a first dielectric layer of the layered substrate of FIG. 23.

A high frequency filter of a second embodiment of the invention will now be described. Reference is now made to FIG. 22 and FIG. 23 to describe the configuration of the high frequency filter of the second embodiment. FIG. 22 is a schematic diagram illustrating the circuit configuration of the high frequency filter of the embodiment. FIG. 23 is a perspective view illustrating an appearance of the high frequency filter of the embodiment.

As shown in FIG. 22, the high frequency filter 101 of the second embodiment incorporates: two input/output terminals 102 and 103 for receiving or outputting signals; and resonators 111, 112 and 113 each of which comprises a TEM line. The resonators 111, 112 and 113 are provided between the input/output terminals 102 and 103 for the sake of the circuit configuration.

Each of the resonators 111, 112 and 113 is a quarter-wave resonator having an open end with the other end short-circuited, and has a shape that is long in one direction. The resonator 113 is disposed between the resonators 111 and 112. The resonators 111, 112 and 113 are disposed in parallel with one another. The adjacent resonators 111 and 113 are inductively coupled to each other. The adjacent resonators 112 and 113 are inductively coupled to each other, too. The resonators 111, 112 and 113 respectively correspond to the first, second and third resonators of the invention.

The high frequency filter 101 further incorporates: a capacitor 121 provided between the open end of the resonator 111 and the ground; a capacitor 122 provided between the open end of the resonator 112 and the ground; and a capacitor 123 provided between the open end of the resonator 113 and the ground. The input/output terminal 102 is connected to the open end of the resonator 111. The input/output terminal 103 is connected to the open end of the resonator 112. The short-circuited end of each of the resonators 111, 112 and 113 is connected to the ground.

The high frequency filter 101 further incorporates: a capacitor 124 provided between the open end of the resonator 111 and the open end of the resonator 113; a capacitor 125 provided between the open end of the resonator 112 and the open end of the resonator 113; and a capacitor 126 provided between the open end of the resonator 111 and the open end of the resonator 112.

As shown in FIG. 23, the high frequency filter 101 further incorporates a layered substrate 130 for integrating components of the high frequency filter 101. The layered substrate 130 includes dielectric layers and conductor layers alternately stacked, which will be described in detail later. Each of the resonators 111, 112 and 113 is formed using at least one of the conductor layers inside the layered substrate 130. The resonators 111, 112 and 113 are distributed constant lines. The capacitors 121 to 126 are formed using the conductor layers and the dielectric layers inside the layered substrate 130.

The adjacent resonators 111 and 113 are inductively coupled to each other. The adjacent resonators 112 and 113 are inductively coupled to each other, too. The resonators 111 and 113 are capacitively coupled to each other through the capacitor 124. The resonators 112 and 113 are capacitively coupled to each other through the capacitor 125. The resonators 111 and 112 are capacitively coupled to each other through the capacitor 126. The resonators 111, 112 and 113 form a band-pass filter that selectively allows signals at frequencies within a specific frequency band to pass. The frequency of two attenuation poles and the pass band width of the band-pass filter are adjustable by adjusting the magnitude of inductive coupling between the resonators 111 and 113, the magnitude of inductive coupling between the resonators 112 and 113, the magnitude of capacitive coupling between the resonators 111 and 113, the magnitude of capacitive coupling between the resonators 112 and 113, and the magnitude of capacitive coupling between the resonators 111 and 112.

The operation of the high frequency filter 101 of the second embodiment will now be described. If signals are inputted to the input/output terminal 102 of the high frequency filter 101, signals at frequencies within a specific frequency band among these signals are selectively allowed to pass through the band-pass filter formed of the resonators 111, 112 and 113, and the signals are outputted from the input/output terminal 103. On the contrary, if signals are inputted to the input/output terminal 103, signals at frequencies within a specific frequency band among these signals are selectively allowed to pass through the band-pass filter formed of the resonators 111, 112 and 113, and the signals are outputted from the input/output terminal 102.

Reference is now made to FIG. 23 to FIG. 38 to describe the configuration of the layered substrate 130 in detail. As shown in FIG. 23, the layered substrate 130 has a shape of rectangular solid having a top surface, a bottom surface, and four side surfaces. On the top surface, the side surfaces and the bottom surface of the layered substrate 130, there are disposed the terminals 102 and 103 and two ground terminals 131 and 132.

Figure 36:
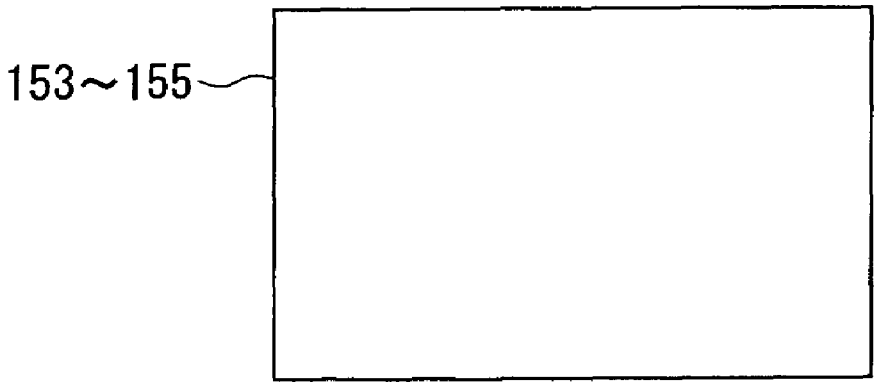
FIG. 36 is a top view representatively illustrating the top surfaces of thirteenth to fifteenth dielectric layers of the layered substrate of FIG. 23.
Figure 37:
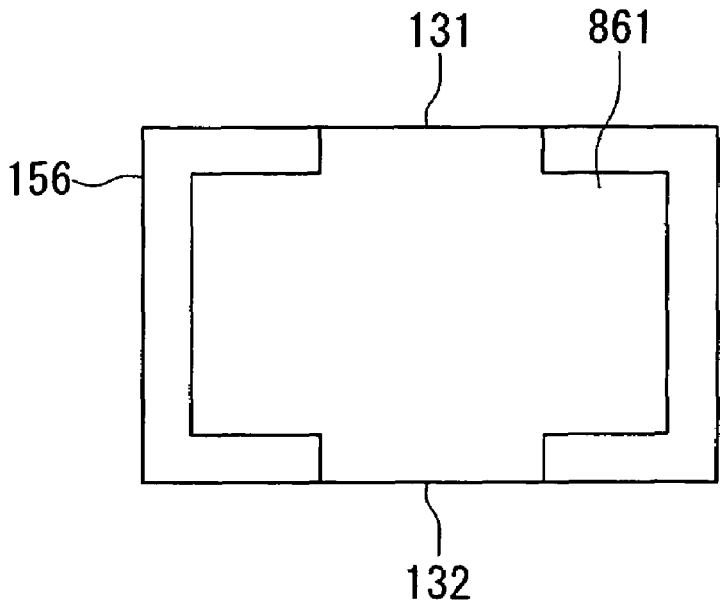
FIG. 37 is a top view of the top surface of a sixteenth dielectric layer of the layered substrate of FIG. 23.
Figure 38:
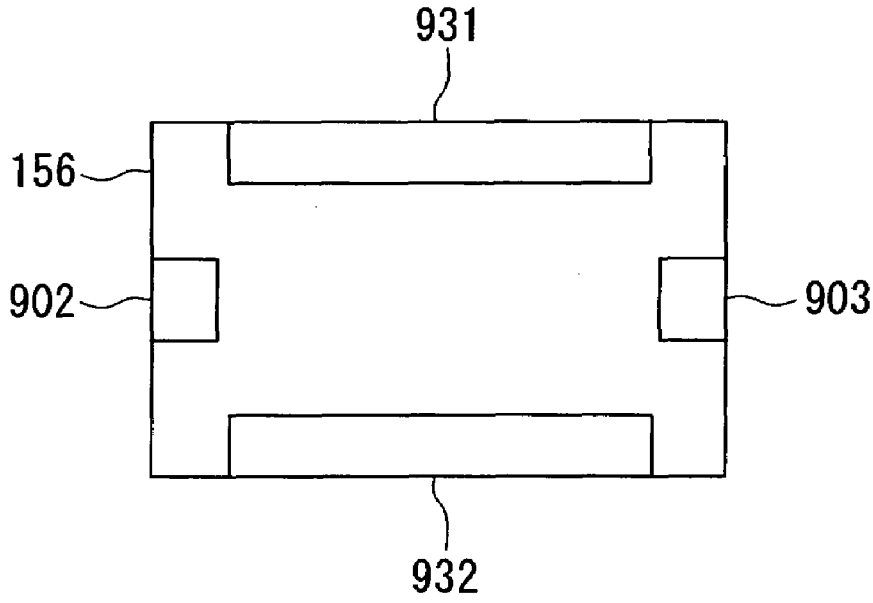
FIG. 38 is a top view of the top surface of the sixteenth dielectric layer and a conductor layer therebelow of the layered substrate of FIG. 23.

FIG. 24 to FIG. 35 respectively illustrate the top surfaces of the first dielectric layer to the twelfth dielectric layer from the top. FIG. 36 is a view representatively illustrating the top surfaces of the thirteenth to fifteenth dielectric layers from the top. FIG. 37 illustrates the top surface of the sixteenth dielectric layer from the top. FIG. 38 illustrates the sixteenth dielectric layer and a conductor layer therebelow seen from above. No conductor layer is formed on the top surface of the first dielectric layer 141 of FIG. 24.

Figure 25:
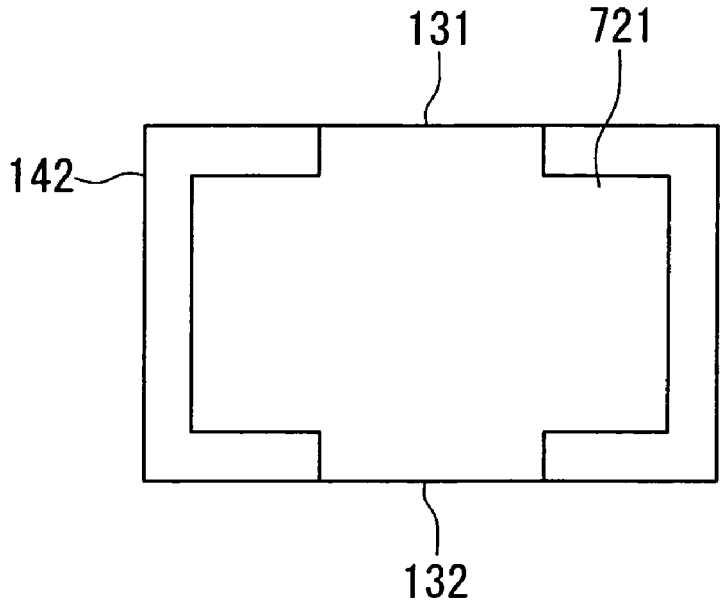
FIG. 25 is a top view of the top surface of a second dielectric layer of the layered substrate of FIG. 23.

A conductor layer 721 for grounding is formed on the top surface of the second dielectric layer 142 of FIG. 25. The conductor layer 721 is connected to the ground terminals 131 and 132.

Figure 26:
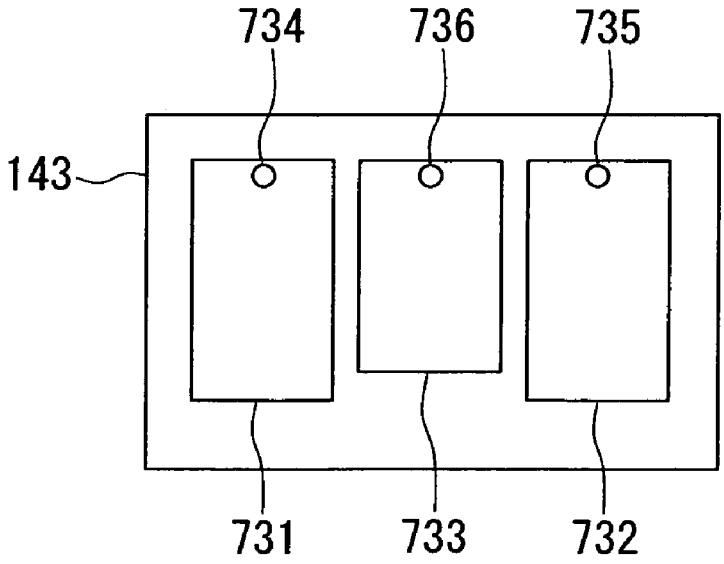
FIG. 26 is a top view of the top surface of a third dielectric layer of the layered substrate of FIG. 23.

Conductor layers 731, 732 and 733 for electrodes are formed on the top surface of the third dielectric layer 143 of FIG. 26. The conductor layers 731, 732 and 733 are opposed to the conductor layer 721 of FIG. 25 with the dielectric layer 142 of FIG. 25 disposed in between. The dielectric layer 143 has through holes 734, 735 and 736 that are connected to the conductor layers 731, 732 and 733, respectively.

Figure 27:
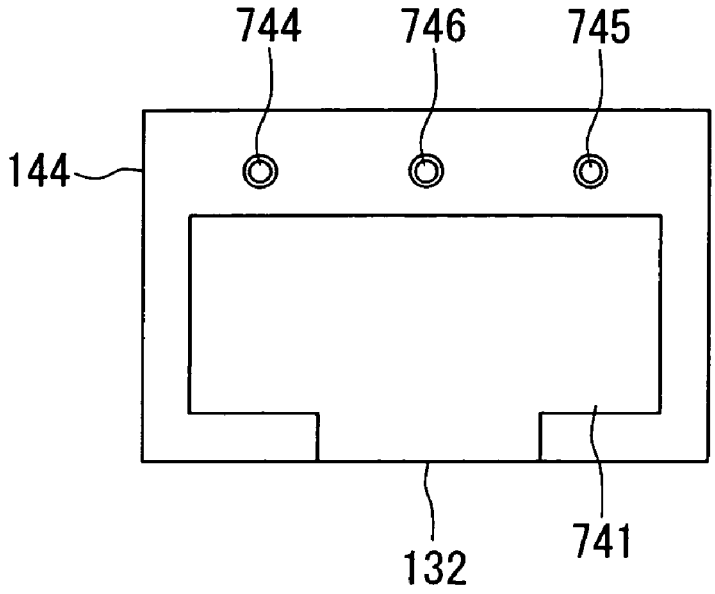
FIG. 27 is a top view of the top surface of a fourth dielectric layer of the layered substrate of FIG. 23.

A conductor layer 741 for grounding is formed on the top surface of the fourth dielectric layer 144 of FIG. 27. The conductor layer 741 is connected to the ground terminal 132. The conductor layer 741 is opposed to the conductor layers 731, 732 and 733 of FIG. 26 with the dielectric layer 143 of FIG. 26 disposed in between. The dielectric layer 144 has through holes 744, 745 and 746. The through holes 734, 735 and 736 of FIG. 26 are connected to the through holes 744, 745 and 746, respectively.

Figure 28:
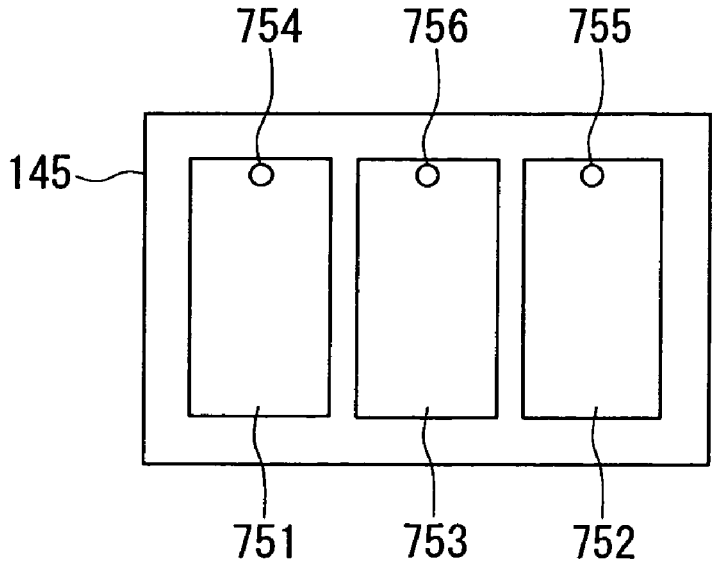
FIG. 28 is a top view of the top surface of a fifth dielectric layer of the layered substrate of FIG. 23.

Conductor layers 751, 752 and 753 for electrodes are formed on the top surface of the fifth dielectric layer 145 of FIG. 28. The conductor layers 751, 752 and 753 are opposed to the conductor layer 741 of FIG. 27 with the dielectric layer 144 of FIG. 27 disposed in between. The dielectric layer 145 has through holes 754, 755 and 756 that are connected to the conductor layers 751, 752 and 753, respectively. The through holes 744, 745 and 746 of FIG. 27 are connected to the through holes 754, 755 and 756, respectively.

The capacitor 121 of FIG. 22 is formed of the conductor layers 721, 731, 741 and 751 and the dielectric layers 142, 143 and 144. The capacitor 122 of FIG. 22 is formed of the conductor layers 721, 732, 741 and 752 and the dielectric layers 142, 143 and 144. The capacitor 123 of FIG. 22 is formed of the conductor layers 721, 733, 741 and 753 and the dielectric layers 142, 143 and 144.

Figure 29:
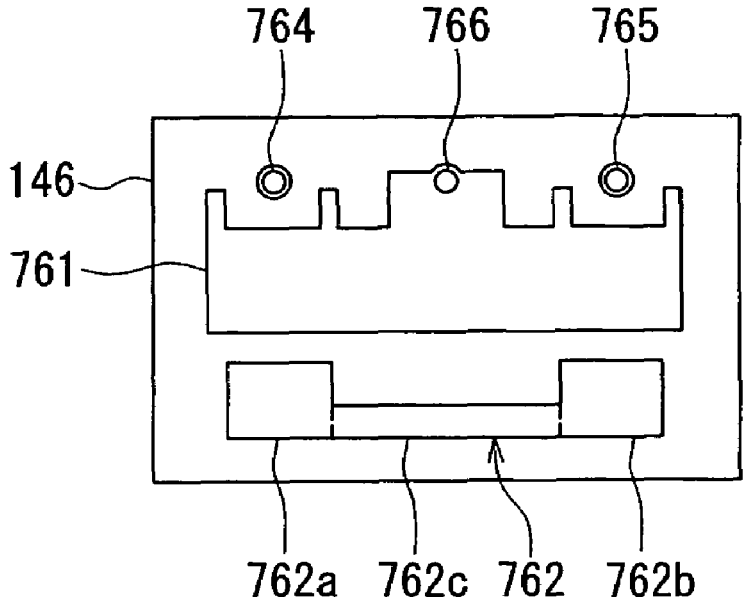
FIG. 29 is a top view of the top surface of a sixth dielectric layer of the layered substrate of FIG. 23.

Conductor layers 761 and 762 for capacitive coupling are formed on the top surface of the sixth dielectric layer 146 of FIG. 29. The conductor layer 761 is opposed to the conductor layers 751, 752 and 753 of FIG. 28 with the dielectric layer 145 of FIG. 28 disposed in between. The dielectric layer 146 has through holes 764, 765 and 766. The through hole 766 is connected to the conductor layer 761. The through holes 754, 755 and 756 of FIG. 28 are connected to the through holes 764, 765 and 766, respectively.

The conductor layer 762 has: a first portion 762*a* for forming a capacitor between itself and the resonator 111; a second portion 762*b* for forming a capacitor between itself and the resonator 112; and a third portion 762*c* having an end connected to the first portion 762*a* and the other end connected to the second portion 762*b*, the ends being opposed to each other in the longitudinal direction. The first portion 762*a*, the second portion 762*b* and the third portion 762*c* are respectively opposed to the conductor layers 751, 752 and 753 of FIG. 28 with the dielectric layer 145 of FIG. 28 disposed in between.

In the conductor layer 762, the width of the third portion 762*c* is smaller than the width of each of the first portion 762*a* and the second portion 762*b*. Here, the widths of the first portion 762*a*, the second portion 762*b* and the third portion 762*c* mean the respective lengths of the first portion 762*a*, the second portion 762*b* and the third portion 762*c* taken in the direction that is parallel to the top surface of the conductor layer 762 and that intersects the longitudinal direction of the third portion 762*c* at a right angle.

Figure 30:
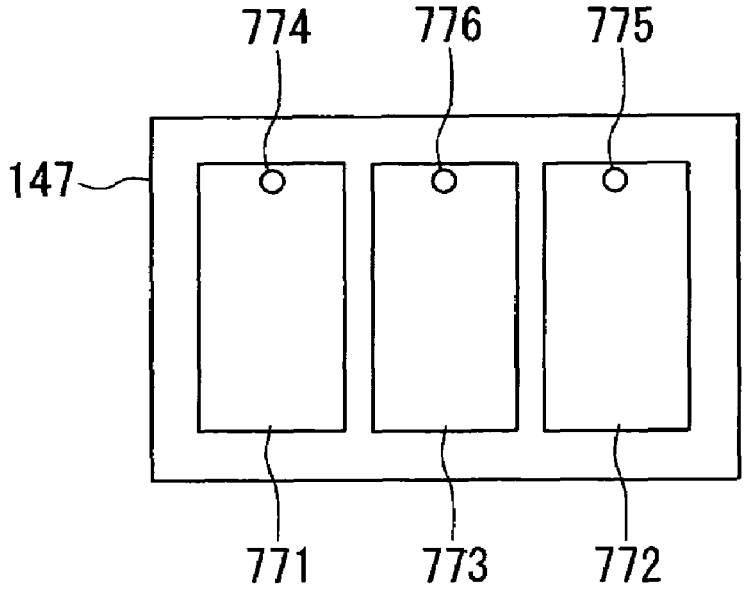
FIG. 30 is a top view of the top surface of a seventh dielectric layer of the layered substrate of FIG. 23.

Conductor layers 771, 772 and 773 for electrodes are formed on the top surface of the seventh dielectric layer 147 of FIG. 30. The conductor layers 771, 772 and 773 are opposed to the conductor layer 761 of FIG. 27 with the dielectric layer 146 of FIG. 29 disposed in between. The conductor layers 771, 772 and 773 are respectively opposed to the first portion 762*a*, the second portion 762*b* and the third portion 762*c* of the conductor layer 762 of FIG. 27 with the dielectric layer 146 of FIG. 29 disposed in between. The dielectric layer 147 has through holes 774, 775 and 776 that are connected to the conductor layers 771, 772 and 773, respectively. The through holes 764, 765 and 766 of FIG. 29 are connected to the through holes 774, 775 and 776, respectively.

The capacitor 124 of FIG. 22 is formed of the conductor layers 751, 753, 761, 771 and 773 and the dielectric layers 145 and 146. The capacitor 125 of FIG. 22 is formed of the conductor layers 752, 753, 761, 772 and 773 and the dielectric layers 145 and 146.

As shown in FIG. 28 to FIG. 30, the first portion 762*a* of the conductor layer 762 is opposed to the conductor layer 751 with the dielectric layer 145 disposed in between, and opposed to the conductor layer 771 with the dielectric layer 146 disposed in between. A capacitor corresponding to the first capacitor of the invention is formed of the first portion 762*a*, the conductor layers 751 and 771, and the dielectric layers 145 and 146. In addition, the second portion 762*b* of the conductor layer 762 is opposed to the conductor layer 752 with the dielectric layer 145 disposed in between, and opposed to the conductor layer 772 with the dielectric layer 146 disposed in between. A capacitor corresponding to the second capacitor of the invention is formed of the second portion 762*b*, the conductor layers 752 and 772, and the dielectric layers 145 and 146. The capacitor formed of the first portion 762*a*, the conductor layers 751 and 771 and the dielectric layers 145 and 146 is connected in series to the capacitor formed of the second portion 762*b*, the conductor layers 752 and 772 and the dielectric layers 145 and 146. These two capacitors constitute the capacitor 126 of FIG. 22.

Figure 31:
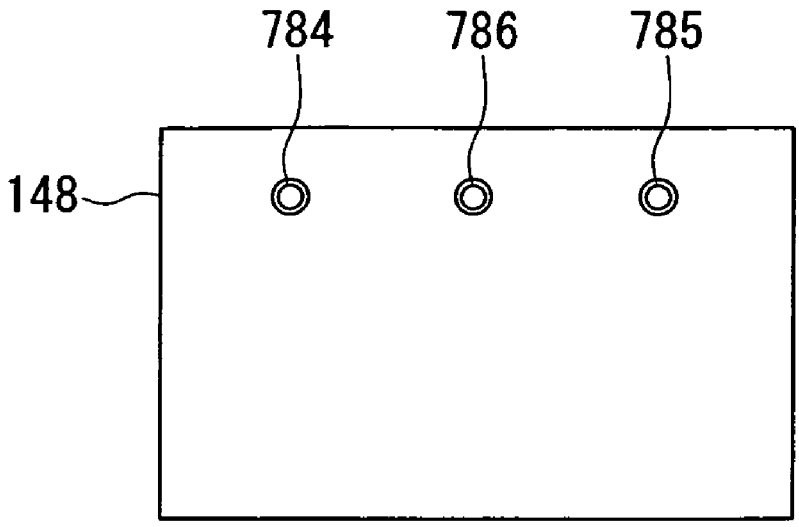
FIG. 31 is a top view of the top surface of an eighth dielectric layer of the layered substrate of FIG. 23.

The eighth dielectric layer 148 of FIG. 31 has through holes 784, 785 and 786. The through holes 774, 775 and 776 of FIG. 30 are connected to the through holes 784, 785 and 786, respectively.

Figure 32:
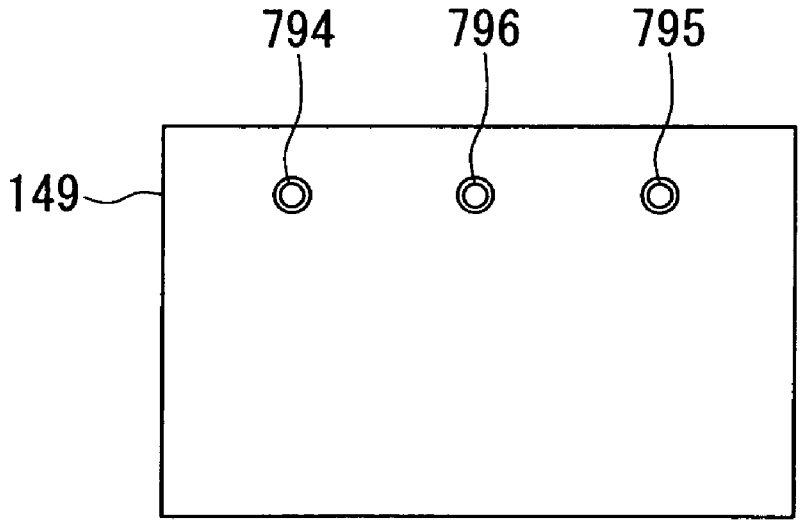
FIG. 32 is a top view of the top surface of a ninth dielectric layer of the layered substrate of FIG. 23.

The ninth dielectric layer 149 of FIG. 32 has through holes 794, 795 and 796. The through holes 784, 785 and 786 of FIG. 31 are connected to the through holes 794, 795 and 796, respectively.

Figure 33:
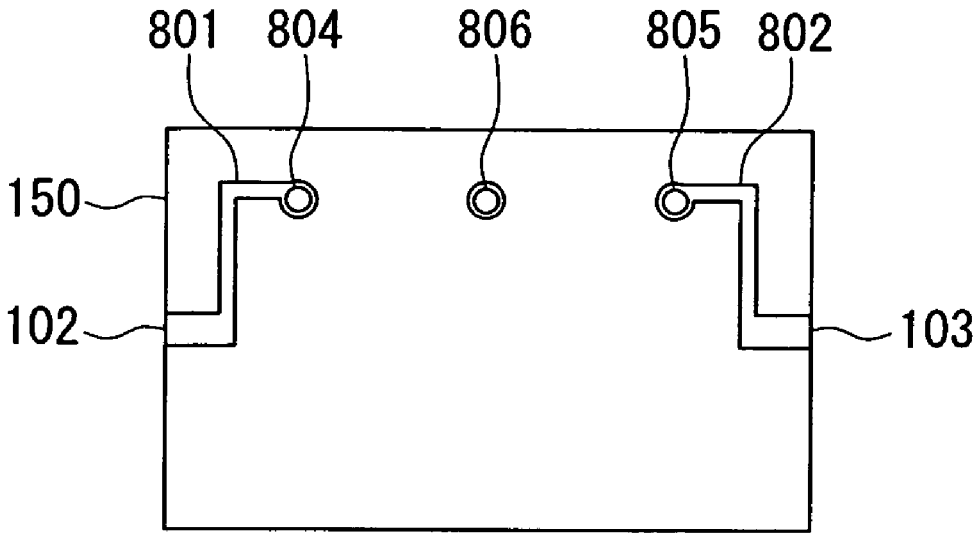
FIG. 33 is a top view of the top surface of a tenth dielectric layer of the layered substrate of FIG. 23.

Conductor layers 801 and 802 are formed on the top surface of the tenth dielectric layer 150 of FIG. 33. An end of the conductor layer 801 is connected to the input/output terminal 102. An end of the conductor layer 802 is connected to the input/output terminal 103. The dielectric layer 150 has through holes 804, 805 and 806. The through hole 804 is connected to the other end of the conductor layer 801. The through hole 805 is connected to the other end of the conductor layer 802. The through holes 794, 795 and 796 of FIG. 32 are respectively connected to the through holes 804, 805 and 806.

Figure 34:
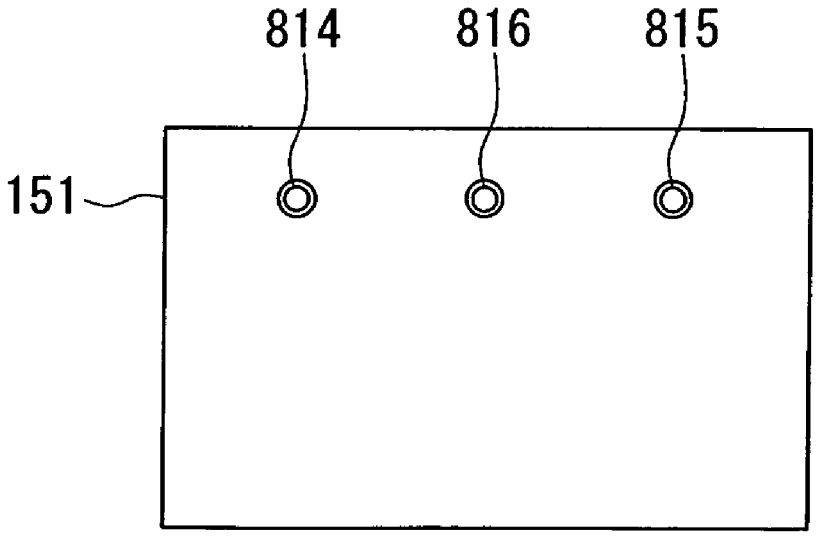
FIG. 34 is a top view of the top surface of an eleventh dielectric layer of the layered substrate of FIG. 23.

The eleventh dielectric layer 151 of FIG. 34 has through holes 814, 815 and 816. The through holes 804, 805 and 806 of FIG. 33 are respectively connected to the through holes 814, 815 and 816.

Figure 35:
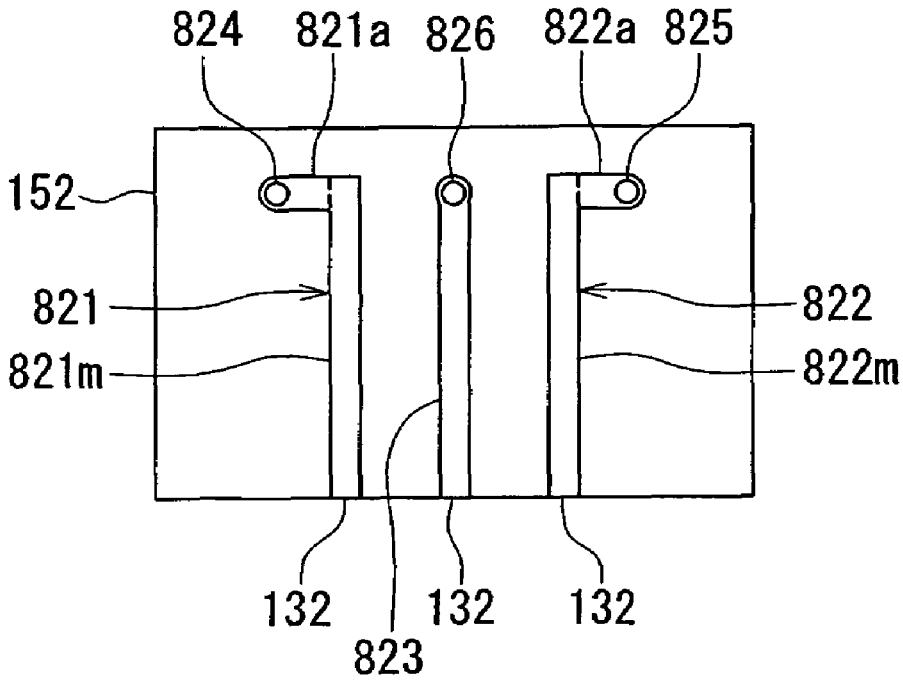
FIG. 35 is a top view of the top surface of a twelfth dielectric layer of the layered substrate of FIG. 23.

Conductor layers 821, 822 and 823 for resonators are formed on the top surface of the twelfth dielectric layer 152 of FIG. 35. The conductor layer 821 has: a main part 821*m* that is long in one direction; and an arm portion 821*a* formed to extend from an end of the main part 821*m*. The conductor layer 822 has: a main part 822*m* that is long in one direction; and an arm portion 822*a* formed to extend from an end of the main part 822*m*. The conductor layer 823 has a shape that is long in one direction. The conductor layers 821, 822 and 823 form the resonators 111, 112 and 113, respectively.

The dielectric layer 152 has through holes 824, 825 and 826. The through hole 824 is connected to the arm portion 821*a*. The through hole 825 is connected to the arm portion 822*a*. The through hole 826 is connected to an end of the conductor layer 823. The through holes 814, 815 and 816 of FIG. 34 are respectively connected to the through holes 824, 825 and 826. The other end of each of the main parts 821*m* and 822*m* and the conductor layer 823 is connected to the ground terminal 132.

The main part 821*m*, the conductor layer 823 and the main part 822*m* are disposed in parallel to one another on the same dielectric layer 152. The conductor layer 823 is disposed between the main parts 821*m* and 822*m*. The conductor layers 821 and 823 are inductively coupled to each other. The conductor layers 822 and 823 are inductively coupled to each other, too.

The conductor layers 731, 751, 771 and 801 are connected to one of the ends of the resonator 111 formed of the conductor layer 821. Among the conductor layers 731, 751, 771 and 801, the conductor layers 751 and 771 correspond to the first electrode of the invention since the conductor layers 751 and 771 are opposed to the first portion 762*a* of the conductor layer 762, with the dielectric layers 145 and 146 respectively disposed in between.

The conductor layers 732, 752, 772 and 802 are connected to one of the ends of the resonator 112 formed of the conductor layer 822. Among the conductor layers 732, 752, 772 and 802, the conductor layers 752 and 772 correspond to the second electrode of the invention since the conductor layers 752 and 772 are opposed to the second portion 762*b* of the conductor layer 762, with the dielectric layers 145 and 146 respectively disposed in between.

The conductor layers 733, 753 and 773 are connected to one of the ends of the resonator 113 formed of the conductor layer 823. Among the conductor layers 733, 753 and 773, the conductor layers 753 and 773 correspond to the third electrode of the invention since the conductor layers 753 and 773 are opposed to the third portion 762*c* of the conductor layer 762, with the dielectric layers 145 and 146 respectively disposed in between.

As shown in FIG. 36, no conductor layers are formed on the top surfaces of the thirteenth to fifteenth dielectric layers 153 to 155.

A conductor layer 861 for grounding is formed on the top surface of the sixteenth dielectric layer 156 of FIG. 37. The conductor layer 861 is connected to the ground terminals 131 and 132.

As shown in FIG. 38, conductor layers 902, 903, 931 and 932 that are respectively connected to the terminals 102, 103, 131 and 132 are formed on the bottom surface of the dielectric layer 156, that is, on the bottom surface of the layered substrate 130.

In the embodiment the layered substrate 130 may be chosen out of a variety of types of substrates, such as one in which the dielectric layers are made of a resin, a ceramic, or a combination of these. However, it is preferred that the layered substrate 130 be a multilayer substrate of low-temperature co-fired ceramic that exhibits an excellent high frequency characteristic.

As described so far, the high frequency filter 101 of the embodiment incorporates the conductor layer 762 for capacitive coupling that is provided for capacitively coupling the resonators 111 and 112 that are not adjacent to each other. The conductor layer 762 has: the first portion 762*a* for forming a capacitor between itself and the resonator 111; the second portion 762*b* for forming a capacitor between itself and the resonator 112; and the third portion 762*c* having an end connected to the first portion 762*a* and the other end connected to the second portion 762*b*, the ends being opposed to each other in the longitudinal direction.

In the conductor layer 762, the width of the third portion 762*c* is smaller than the width of each of the first portion 762*a* and the second portion 762*b*. As a result, according to the embodiment, it is possible to make the capacitance generated between the third portion 762*c* and the resonator 113 smaller, compared with the case in which the width of the third portion 762*c* is equal to or greater than the width of each of the first portion 762*a* and the second portion 762*b*. In the example of FIG. 29 the width of the entire third portion 762*c* is smaller than the width of each of the first portion 762*a* and the second portion 762*b*. In the embodiment, however, it suffices that at least part of the third portion 762*c*, particularly a part thereof opposed to the conductor layers 753 and 773, is smaller in width than each of the first portion 762*a* and the second portion 762*b*. The above-mentioned effect is thereby obtained.

From the foregoing, according to the embodiment, it is possible to adjust the magnitude of capacitive coupling between the resonators 111 and 112 that are not adjacent to each other while reducing the magnitude of capacitive coupling between the resonators 111 and 113 and the magnitude of capacitive coupling between the resonators 112 and 113 generated by the conductor layer 762. As a result, according to the embodiment, it is easy to adjust the characteristics of the high frequency filter 101.

As in the first embodiment, it is preferred that, in the conductor layer 762, the width of at least part of the third portion 762*c* be equal to or smaller than a half of the width of the first portion 762*a* and equal to or smaller than a half of the width of the second portion 762*b*.

In the second embodiment, the capacitors 121 to 123 are provided between the ground and the respective ends of the resonators 111 to 113. As a result, according to the embodiment, it is possible to make the physical length of each of the resonators 111 to 113 smaller than one fourth of the wavelength corresponding to the center frequency of the pass band of the band-pass filter. It is thereby possible to reduce the size of the high frequency filter 101.

Third Embodiment

Figure 39:
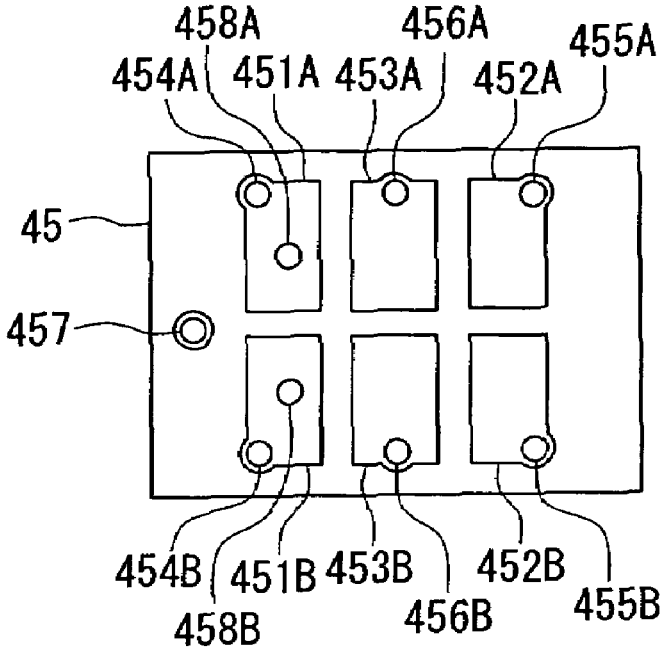
FIG. 39 is a top view of the top surface of a fifth dielectric layer of a high frequency filter of a third embodiment of the invention.
Figure 40:
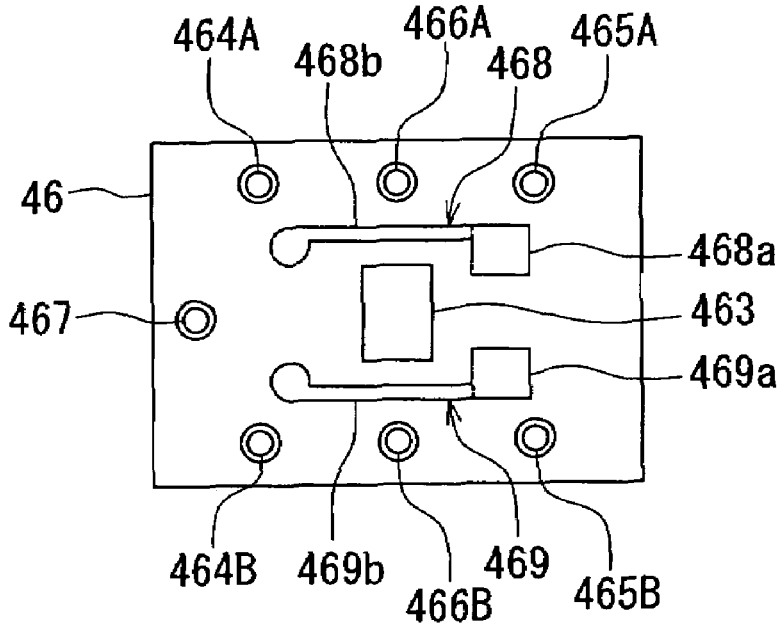
FIG. 40 is a top view of the top surface of a sixth dielectric layer of the high frequency filter of the third embodiment of the invention.

Reference is now made to FIG. 39 and FIG. 40 to describe a high frequency filter of a third embodiment of the invention. The high frequency filter 1 of the third embodiment has a circuit configuration and an appearance the same as those of the first embodiment. In the high frequency filter 1 of the third embodiment, the configuration of a conductor layer formed on the top surface of the fifth dielectric layer from the top of the layered substrate 30 and the configuration of through holes formed in the fifth dielectric layer and the configuration of a conductor layer formed on the top surface of the sixth dielectric layer from the top of the layered substrate 30 are different from those of the first embodiment. FIG. 39 illustrates the top surface of the fifth dielectric layer of the third embodiment. FIG. 40 illustrates the top surface of the sixth dielectric layer of the third embodiment.

As in the first embodiment, the conductor layers 451A, 451B, 452A, 452B, 453A and 453B for electrodes are formed on the top surface of the fifth dielectric layer 45 of FIG. 39. As in the first embodiment, the dielectric layer 45 has: the through holes 454A, 454B, 455A, 455B, 456A and 456B that are connected to the conductor layers 451A, 451B, 452A, 452B, 453A and 453B, respectively; and the through hole 457. In the third embodiment, the dielectric layer 45 further has through holes 458A and 458B that are connected to the conductor layers 451A and 451B, respectively.

Conductor layers 468 and 469 for capacitive coupling and the conductor layer 463 are formed on the top surface of the sixth dielectric layer 46 of FIG. 40. The conductor layer 468 has: a capacitor-forming portion 468*a* for forming a capacitor between itself and the resonator 12; and a coupling portion 468*b* having an end connected to the capacitor-forming portion 468*a* and the other end connected to the resonator 11, the ends being opposed to each other in the longitudinal direction. The conductor layer 469 has: a capacitor-forming portion 469*a* for forming a capacitor between itself and the resonator 12; and a coupling portion 469*b* having an end connected to the capacitor-forming portion 469*a* and the other end connected to the resonator 11, the ends being opposed to each other in the longitudinal direction.

The capacitor-forming portion 468*a* is opposed to the conductor layer 452A of FIG. 39 with the dielectric layer 45 of FIG. 39 disposed in between. The other end of the coupling portion 468*b* is connected to the conductor layer 451A of FIG. 39 via the through hole 458A of FIG. 39. Similarly, the capacitor-forming portion 469*a* is opposed to the conductor layer 452B of FIG. 39 with the dielectric layer 45 of FIG. 39 disposed in between. The other end of the coupling portion 469*b* is connected to the conductor layer 451B of FIG. 39 via the through hole 458B of FIG. 39. The conductor layer 463 is opposed to the conductor layers 453A and 453B of FIG. 39 with the dielectric layer 45 of FIG. 39 disposed in between.

In the conductor layer 468 the width of the coupling portion 468*b* is smaller than the width of the capacitor-forming portion 468*a*. Here, the widths of the capacitor-forming portion 468*a* and the coupling portion 468*b* mean the respective lengths of the capacitor-forming portion 468*a* and the coupling portion 468*b* taken in the direction that is parallel to the top surface of the conductor layer 468 and that intersects the longitudinal direction of the coupling portion 468*b* at a right angle.

Similarly, in the conductor layer 469, the width of the coupling portion 469*b* is smaller than the width of the capacitor-forming portion 469*a*. Here, the widths of the capacitor-forming portion 469*a* and the coupling portion 469*b* mean the respective lengths of the capacitor-forming portion 469*a* and the coupling portion 469*b* taken in the direction that is parallel to the top surface of the conductor layer 469 and that intersects the longitudinal direction of the coupling portion 469*b* at a right angle.

As in the first embodiment, the dielectric layer 46 has the through holes 464A, 464B, 465A, 465B, 466A, 466B and 467.

The capacitor-forming portion 468*a* and the coupling portion 468*b* of the conductor layer 468 of FIG. 40 are respectively opposed to the conductor layers 472A and 473A of FIG. 9 with the dielectric layer 46 disposed in between. Similarly, the capacitor forming portion 469*a* and the coupling portion 469*b* of the conductor layer 469 shown in FIG. 40 are respectively opposed to the conductor layers 472B and 473B of FIG. 9 with the dielectric layer 46 disposed in between.

As shown in FIG. 39, FIG. 40 and FIG. 9, the capacitor-forming portion 468*a* of the conductor layer 468 is opposed to the conductor layer 452A with the dielectric layer 45 disposed in between, and opposed to the conductor layer 472A with the dielectric layer 46 disposed in between. A capacitor is formed of the capacitor-forming portion 468*a*, the conductor layers 452A and 472A, and the dielectric layers 45 and 46. This capacitor is the capacitor 27 of FIG. 1.

Similarly, the capacitor-forming portion 469*a* of the conductor layer 469 is opposed to the conductor layer 452B with the dielectric layer 45 disposed in between, and opposed to the conductor layer 472B with the dielectric layer 46 disposed in between. Between the conductor layer 469 and the resonator 12, a capacitor is formed of the capacitor-forming portion 469*a*, the conductor layers 452B and 472B, and the dielectric layers 45 and 46. This capacitor is the capacitor 28 of FIG. 1.

As described so far, the high frequency filter 1 of the third embodiment incorporates the conductor layers 468 and 469 for capacitive coupling that are provided for capacitively coupling the resonators 11 and 12 that are not adjacent to each other. The conductor layer 468 has: the capacitor-forming portion 468*a* for forming a capacitor between itself and the resonator 12; and the coupling portion 468*b* having an end connected to the capacitor-forming portion 468*a* and the other end connected to the resonator 11, the ends being opposed to each other in the longitudinal direction. The conductor layer 469 has: the capacitor-forming portion 469*a* for forming a capacitor between itself and the resonator 12; and the coupling portion 469*b* having an end connected to the capacitor-forming portion 469*a* and the other end connected to the resonator 11, the ends being opposed to each other in the longitudinal direction.

In the conductor layer 468, the width of the coupling portion 468*b* is smaller than the width of the capacitor-forming portion 468*a*. As a result, according to the embodiment, it is possible to make the capacitance generated between the coupling portion 468*b* and the resonator 13 smaller, compared with the case in which the width of the coupling portion 468*b* is equal to or greater than the width of the capacitor-forming portion 468*a*. In the example of FIG. 40, the width of the entire coupling portion 468*b* is smaller than the width of the capacitor-forming portion 468*a*. In the embodiment, however, it suffices that at least part of the coupling portion 468*b*, particularly a part thereof opposed to the conductor layers 453A and 473A, is smaller in width than the capacitor-forming portion 468*a*. The above-mentioned effect is thereby obtained.

Similarly, in the conductor layer 469, the width of the coupling portion 469*b* is smaller than the width of the capacitor-forming portion 469*a*. As a result, according to the embodiment, it is possible to make the capacitance generated between the coupling portion 469*b* and the resonator 13 smaller, compared with the case in which the width of the coupling portion 469*b* is equal to or greater than the width of the capacitor-forming portion 469*a*. In the example of FIG. 40, the width of the entire coupling portion 469*b* is smaller than the width of the capacitor-forming portion 469*a*. In the embodiment, however, it suffices that at least part of the coupling portion 469*b*, particularly a part thereof opposed to the conductor layers 453B and 473B, is smaller in width than the capacitor-forming portion 469*a*. The above-mentioned effect is thereby obtained.

From the foregoing, according to the embodiment, it is possible to adjust the magnitude of capacitive coupling between the resonators 11 and 12 that are not adjacent to each other while reducing the magnitude of capacitive coupling between the resonators 11 and 13 and the magnitude of capacitive coupling between the resonators 12 and 13 generated by the conductor layers 468 and 469. As a result, according to the embodiment, it is easy to adjust the characteristics of the high frequency filter 1.

As in the first embodiment, it is preferred that, in the conductor layer 468, the width of at least part of the coupling portion 468*b* be equal to or smaller than a half of the width of the capacitor-forming portion 468*a* and that, in the conductor layer 469, the width of at least part of the coupling portion 469*b* be equal to or smaller than a half of the width of the capacitor-forming portion 469*a*.

According to the third embodiment, it is possible that the area of the region required to form the capacitors 27 and 28 is smaller, compared with the first embodiment. It is therefore possible to reduce the size of the high frequency filter 1.

In the third embodiment, the conductor layer 468 for capacitive coupling may have: a capacitor-forming portion for forming a capacitor between itself and the resonator 11; and a coupling portion having an end connected to the capacitor-forming portion and the other end connected to the resonator 12, the ends being opposed to each other in the longitudinal direction. In this case, the conductor layer 468 has a shape that is laterally symmetric with the one shown in FIG. 40, for example, and, in the dielectric layer 45 of FIG. 39, the through hole 458A is replaced with a through hole that is connected to the conductor layer 452A and connected to the other end of the coupling portion of the conductor layer 468.

Similarly, the conductor layer 469 may have: a capacitor-forming portion for forming a capacitor between itself and the resonator 11; and a coupling portion having an end connected to the capacitor-forming portion and the other end connected to the resonator 12, the ends being opposed to each other in the longitudinal direction. In this case, the conductor layer 469 has a shape that is laterally symmetric with the one shown in FIG. 40, for example, and, in the dielectric layer 45 of FIG. 39, the through hole 458B is replaced with a through hole that is connected to the conductor layer 452B and connected to the other end of the coupling portion of the conductor layer 469.

The remainder of configuration, function and effects of the third embodiment are similar to those of the first embodiment.

Fourth Embodiment

Figure 41:
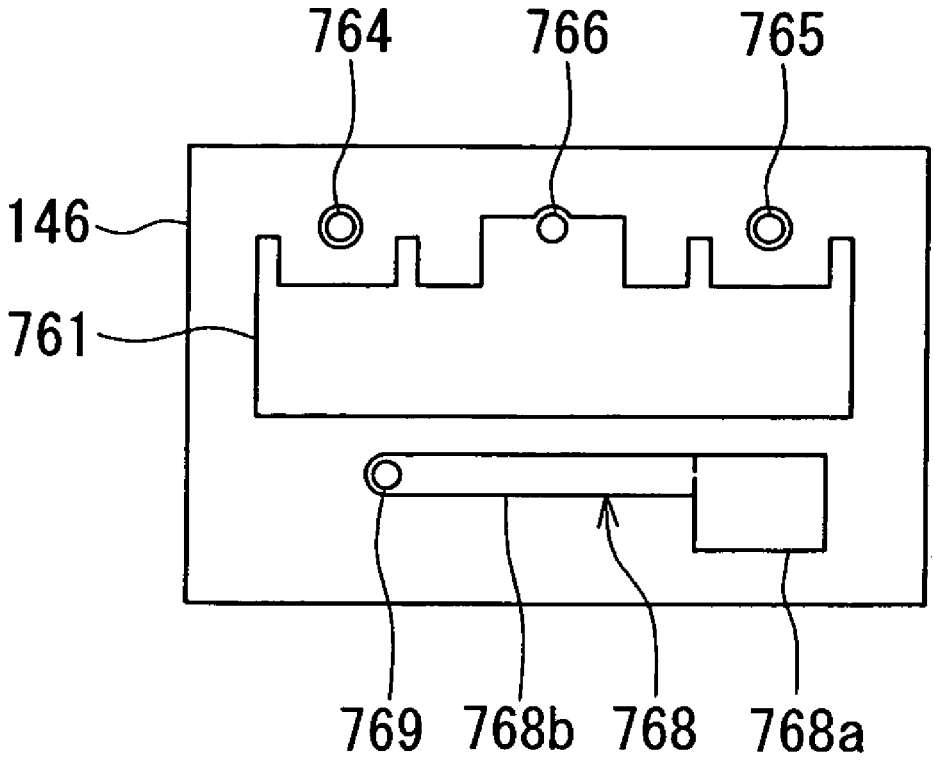
FIG. 41 is a top view of the top surface of a sixth dielectric layer of a high frequency filter of a fourth embodiment of the invention.

Reference is now made to FIG. 41 to describe a high frequency filter of a fourth embodiment of the invention. The high frequency filter 101 of the fourth embodiment has a circuit configuration and an appearance the same as those of the second embodiment. In the high frequency filter 101 of the fourth embodiment, the configuration of a conductor layer formed on the top surface of the sixth dielectric layer from the top of the layered substrate 130 and the configuration of through holes formed in the sixth dielectric layer are different from those of the second embodiment. FIG. 41 illustrates the top surface of the sixth dielectric layer of the fourth embodiment.

The conductor layer 761 and a conductor layer 768 for capacitive coupling are formed on the top surface of the sixth dielectric layer 146 of FIG. 41. The conductor layer 761 has a configuration the same as that of the second embodiment. The dielectric layer 146 has the through holes 764, 765 and 766 the same as those of the second embodiment.

The conductor layer 768 has: a capacitor-forming portion 768*a* for forming a capacitor between itself and the resonator 112; and a coupling portion 768*b* having an end connected to the capacitor-forming portion 768*a* and the other end connected to the resonator 111, the ends being opposed to each other in the longitudinal direction. The dielectric layer 146 further has a through hole 769 connected to the other end of the coupling portion 768*b*.

The capacitor-forming portion 768*a* is opposed to the conductor layer 752 of FIG. 28 with the dielectric layer 145 of FIG. 28 disposed in between, and opposed to the conductor layer 772 of FIG. 30 with the dielectric layer 146 of FIG. 41 disposed in between. A capacitor is formed of the capacitor-forming portion 768*a*, the conductor layers 752 and 772, and the dielectric layers 145 and 146. This capacitor is the capacitor 126 of FIG. 22.

The coupling portion 768*b* is opposed to the conductor layer 753 of FIG. 28 with the dielectric layer 145 of FIG. 28 disposed in between, and opposed to the conductor layer 773 of FIG. 30 with the dielectric layer 146 of FIG. 41 disposed in between. The other end of the coupling portion 768*b* is connected to the conductor layer 771 of FIG. 30 via the through hole 769 of FIG. 41.

In the conductor layer 768, the width of the coupling portion 768*b* is smaller than the width of the capacitor-forming portion 768*a*. Here, the widths of the capacitor-forming portion 768*a* and the coupling portion 768*b* mean the respective lengths of the capacitor-forming portion 768*a* and the coupling portion 768*b* taken in the direction that is parallel to the top surface of the conductor layer 768 and that intersects the longitudinal direction of the coupling portion 768*b* at a right angle.

As described so far, the high frequency filter 101 of the fourth embodiment incorporates the conductor layer 768 for capacitive coupling that is provided for capacitively coupling the resonators 111 and 112 that are not adjacent to each other. The conductor layer 768 has: the capacitor-forming portion 768*a* for forming a capacitor between itself and the resonator 112; and the coupling portion 768*b* having an end connected to the capacitor-forming portion 768*a* and the other end connected to the resonator 111, the ends being opposed to each other in the longitudinal direction.

In the conductor layer 768, the width of the coupling portion 768*b* is smaller than the width of the capacitor-forming portion 768*a*. As a result, according to the embodiment, it is possible to make the capacitance generated between the coupling portion 768*b* and the resonator 113 smaller, compared with the case in which the width of the coupling portion 768*b* is equal to or greater than the width of the capacitor-forming portion 768*a*. In the example of FIG. 41, the width of the entire coupling portion 768*b* is smaller than the width of the capacitor-forming portion 768*a*. In the embodiment, however, it suffices that at least part of the coupling portion 768*b*, particularly a part thereof opposed to the conductor layers 753 and 773, is smaller in width than the capacitor-forming portion 768*a*. The above-mentioned effect is thereby obtained.

From the foregoing, according to the embodiment, it is possible to adjust the magnitude of capacitive coupling between the resonators 111 and 112 that are not adjacent to each other while reducing the magnitude of capacitive coupling between the resonators 111 and 113 and the magnitude of capacitive coupling between the resonators 112 and 113 generated by the conductor layer 768. As a result, according to the embodiment, it is easy to adjust the characteristics of the high frequency filter 101.

As in the second embodiment, it is preferred that, in the conductor layer 768, the width of at least part of the coupling portion 768*b* be equal to or smaller than a half of the width of the capacitor-forming portion 768*a*.

According to the fourth embodiment, it is possible that the area of the region required to form the capacitor 126 is smaller, compared with the second embodiment. It is therefore possible to reduce the size of the high frequency filter 101.

In the fourth embodiment, the conductor layer 768 for capacitive coupling may have: a capacitor-forming portion for forming a capacitor between itself and the resonator 111; and a coupling portion having an end connected to the capacitor-forming portion and the other end connected to the resonator 112, the ends being opposed to each other in the longitudinal direction. In this case, the conductor layer 768 has a shape that is laterally symmetric with the one shown in FIG. 41, for example, and, in the dielectric layer 146 of FIG. 41, the through hole 769 is replaced with a through hole that is connected to the conductor layer 772 and connected to the other end of the coupling portion of the conductor layer 468.

The remainder of configuration, function and effects of the fourth embodiment are similar to those of the second embodiment.

The present invention is not limited to the foregoing embodiments but may be practiced in still other ways. For example, the high frequency filter of the invention may incorporate four or more resonators including the first to third resonators.

The high frequency filter of the invention is useful as a filter used in communications apparatuses conforming to the Bluetooth standard and those for use on a wireless LAN, such as a band-pass filter in particular.

Obviously many modifications and variations of the present invention are possible in the light of the above teachings. It is therefore to be understood that within the scope of the appended claims the invention may be practiced otherwise than as specifically described.

What is claimed is:

1. A high frequency filter comprising:

a layered substrate including dielectric layers and conductor layers that are alternately stacked; and a first resonator, a second resonator and a third resonator each of which is formed using at least one of the conductor layers inside the layered substrate, wherein:

the third resonator is disposed between the first and second resonators; and the first and third resonators are inductively coupled to each other while the second and third resonators are inductively coupled to each other, the high frequency filter further comprising at least one conductor layer for capacitive coupling that is made of at least one of the conductor layers inside the layered substrate and provided for capacitively coupling the first and second resonators to each other, wherein:

the at least one conductor layer for capacitive coupling incorporates: a first portion for forming a first capacitor between itself and the first resonator; a second portion for forming a second capacitor between itself and the second resonator; and a third portion having an end connected to the first portion and the other end connected to the second portion, the ends being opposed to each other in a longitudinal direction; and a width of at least part of the third portion is smaller than a width of each of the first portion and the second portion.

2. The high frequency filter according to claim 1, wherein the width of the at least part of the third portion is equal to or smaller than a half of the width of each of the first portion and the second portion.

3. The high frequency filter according to claim 1, further comprising a first electrode, a second electrode and a third electrode each of which is made of one of the conductor layers inside the layered substrate, the first to third electrodes being connected to the first to third resonators, respectively, wherein the first to third electrodes are opposed to the first to third portions, respectively, with one of the dielectric layers inside the layered substrate disposed in between.

4. The high frequency filter according to claim 1, wherein the first and third resonators are further capacitively coupled to each other, and the second and third resonators are further capacitively coupled to each other.

5. The high frequency filter according to claim 1, wherein each of the first to third resonators is a half-wave resonator with open ends, the number of the at least one conductor layer for capacitive coupling is two, and one of the two conductor layers for capacitive coupling couples one of the ends of the first resonator to one of the ends of the second resonator while the other of the two conductor layers for capacitive coupling couples the other of the ends of the first resonator to the other of the ends of the second resonator.

6. The high frequency filter according to claim 1, wherein each of the first to third resonators is a quarter-wave resonator having an open end with the other end short-circuited, and the at least one conductor layer for capacitive coupling couples the other end of the first resonator to the other end of the second resonator.

7. A high frequency filter comprising:

a layered substrate including dielectric layers and conductor layers that are alternately stacked; and a first resonator, a second resonator and a third resonator each of which is formed using at least one of the conductor layers inside the layered substrate, wherein:

the third resonator is disposed between the first and second resonators; and the first and third resonators are inductively coupled to each other while the second and third resonators are inductively coupled to each other, the high frequency filter further comprising at least one conductor layer for capacitive coupling that is made of at least one of the conductor layers inside the layered substrate and provided for capacitively coupling the first and second resonators to each other, wherein:

the at least one conductor layer for capacitive coupling incorporates: a capacitor-forming portion for forming a capacitor between itself and one of the first and second resonators; and a coupling portion having an end connected to the capacitor-forming portion and the other end connected to the other one of the first and second resonators, the ends being opposed to each other in a longitudinal direction; and a width of at least part of the coupling portion is smaller than a width of the capacitor-forming portion.

8. The high frequency filter according to claim 7, wherein the width of the at least part of the coupling portion is equal to or smaller than a half of the width of the capacitor-forming portion.

9. The high frequency filter according to claim 7, further comprising a first electrode, a second electrode and a third electrode each of which is made of one of the conductor layers inside the layered substrate, the first to third electrodes being connected to the first to third resonators, respectively, wherein one of the first and second electrodes is opposed to the capacitor-forming portion with one of the dielectric layers inside the layered substrate disposed in between, while the third electrode is opposed to the coupling portion with one of the dielectric layers inside the layered substrate disposed in between.

10. The high frequency filter according to claim 7, wherein the first and third resonators are further capacitively coupled to each other, and the second and third resonators are further capacitively coupled to each other.

11. The high frequency filter according to claim 7, wherein each of the first to third resonators is a half-wave resonator with open ends, the number of the at least one conductor layer for capacitive coupling is two, and one of the two conductor layers for capacitive coupling couples one of the ends of the first resonator to one of the ends of the second resonator while the other of the two conductor layers for capacitive coupling couples the other of the ends of the first resonator to the other of the ends of the second resonator.

12. The high frequency filter according to claim 7, wherein each of the first to third resonators is a quarter-wave resonator having an open end with the other end short-circuited, and the at least one conductor layer for capacitive coupling couples the other end of the first resonator to the other end of the second resonator.

* * * * *